US012595710B2

(12) United States Patent
Westcott

(10) Patent No.: US 12,595,710 B2
(45) Date of Patent: Apr. 7, 2026

(54) DRILL STRING AND COMPONENTS THEREFOR

(71) Applicant: TRI-TUBE DRILLING SYSTEMS PTY LTD, Fremantle (AU)

(72) Inventor: Timothy Daniel Westcott, Yanchep (AU)

(73) Assignee: TRI-TUBE DRILLING SYSTEMS PTY LTD (AU)

( * ) Notice: Subject to any disclaimer, the term of this patent is extended or adjusted under 35 U.S.C. 154(b) by 0 days.

(21) Appl. No.: 18/705,372

(22) PCT Filed: Oct. 3, 2022

(86) PCT No.: PCT/AU2022/051176
§ 371 (c)(1),
(2) Date: Apr. 26, 2024

(87) PCT Pub. No.: WO2023/070145
PCT Pub. Date: May 4, 2023

(65) Prior Publication Data

US 2025/0230721 A1 Jul. 17, 2025

(30) Foreign Application Priority Data

Oct. 29, 2021 (AU) ..... 2021903466

(51) Int. Cl.
*E21B 21/12* (2006.01)
*E21B 4/02* (2006.01)
(Continued)

(52) U.S. Cl.
CPC ..... *E21B 21/12* (2013.01); *E21B 4/02* (2013.01); *E21B 17/18* (2013.01); *E21B 21/14* (2013.01)

(58) Field of Classification Search
CPC ..... E21B 21/12; E21B 21/14
See application file for complete search history.

(56) References Cited

U.S. PATENT DOCUMENTS 3,958,651 A 5/1976 Young
4,134,619 A 1/1979 Bunnelle
(Continued)

FOREIGN PATENT DOCUMENTS

CN 208294471 U 12/2018
CN 109853571 B 6/2019
(Continued)

OTHER PUBLICATIONS

Westcott, Timothy Daniel; International Preliminary Report on Patentability for PCT/AU2022/051176, filed Oct. 3, 2022, mailed Nov. 22, 2023, 144 pgs.
(Continued)

*Primary Examiner* — Yanick A Akaragwe
(74) *Attorney, Agent, or Firm* — Taylor Duma LLP

(57) ABSTRACT

A drilling assembly includes a drill bit connected to a gas injector sub-assembly, which is connected to the bottom of a drill rod. The top of the drill rod is connected above ground to an entry sub-assembly, which has connected atop a drill rig rotary head, which drives the connected drill rod. As drilling proceeds, further drill rods may be joined between the drill rod in the hole being drilled and the entry sub-assembly. The drilling assembly has a central cuttings conduit in fluid connection with the drill bit to evacuate cuttings upward, a gas injection passage arranged concentrically around the cuttings conduit to inject gas into the central cuttings conduit in the gas injector sub-assembly to provide lift to the cuttings therein. A drilling liquid passage is arranged concentrically around the cuttings conduit and the gas injection passage to deliver drilling liquid down to the drill bit.

20 Claims, 18 Drawing Sheets

(51) Int. Cl.
*E21B 17/18* (2006.01)
*E21B 21/14* (2006.01)

(56) References Cited

U.S. PATENT DOCUMENTS

| | | | | |
|---|---|---|---|---|
| 4,516,633 | A | 5/1985 | Richardson et al. | |
| 4,534,426 | A * | 8/1985 | Hooper | E21D 1/06 175/215 |
| 4,683,944 | A | 8/1987 | Curlett | |
| 6,460,936 | B1 | 10/2002 | Abramov et al. | |
| 2014/0041942 | A1* | 2/2014 | Able | E21B 17/18 175/173 |
| 2016/0053550 | A1* | 2/2016 | Wilson | E21B 21/12 175/393 |
| 2019/0003261 | A1* | 1/2019 | Tanaka | E21B 10/38 |

FOREIGN PATENT DOCUMENTS

| | | | |
|---|---|---|---|
| CN | 212027661 | U | 11/2020 |
| EP | 3770374 | A1 | 1/2021 |
| GB | 2165283 | A | 4/1986 |
| WO | 2012165573 | | 12/2012 |
| WO | 2023023759 | A3 | 3/2023 |

OTHER PUBLICATIONS

Westcott, Timothy Daniel; International Search Report and Written Opinion for PCT/AU2022/051176, filed Oct. 3, 2022, mailed Nov. 11, 2022, 11 pgs.

* cited by examiner

Section A-A

DRILL STRING AND COMPONENTS THEREFOR

FIELD OF THE INVENTION

This invention relates to geotechnology, and to mining and exploration in the fields of oil, gas, water, and mining. In particular, this invention relates to ground drilling.

BACKGROUND

The following discussion of the background art is intended to facilitate an understanding of the present invention only. It should be appreciated that the discussion is not an acknowledgement or admission that any of the material referred to was part of the common general knowledge as at the priority date of the application.

Various rotary and percussion drilling methods have been adopted and remain in use for the drilling of water wells, oil and gas drilling, mineral exploration, geotechnical and geothermal wells using both single circulation and dual circulation drill string configurations. These drilling methods use either water, drilling mud or fluid (liquid), or compressed air. In the case of mineral exploration, a common down hole tool for drilling medium to hard rocks comprises a down hole air operated hammer of either conventional or reverse circulation type, coupled with single or dual circulation drill strings respectively.

In some cases, down hole hammers are powered by high pressure air and in others, powered by water or a drilling liquid. In the case of reverse circulation air powered hammers commonly used in mineral exploration, the drill cuttings generated while using high pressure air pass through the hammer via a central inner tube and are delivered to surface through dual tube drill rods via an inner tube inside the drill string. An example of this technology is described in U.S. Pat. No. 4,819,746A, which discloses a reverse circulation hammer used in mineral exploration using high pressure air to power the hammer, and to remove drill cuttings through a dual tube drill string, where drill cuttings are removed from the bit face through an inner tube within the drill string.

Oil and gas wells are usually drilled using the single circulation mud rotary method as distinct from air percussion methods or dual circulation methods. Oil and gas drill strings consist of conventional single tube drill rods where drilling liquids or muds are pumped downwards through the drill string and cuttings delivered to surface via the well annulus between the drill pipe and drill hole.

Flooded Mud Dual Circulation Drilling (at times referred to as DTFR drilling) is widely used to drill larger diameter geotechnical holes and water wells. The flooded mud systems currently in use do not use fluid hammers to drill, adopting rotary methods only. A dual tube drill string is used where mud in the well annulus is ideally kept full or level with the ground surface whilst drilling. Drilling mud from the well annulus proximal to the bit face is drawn into the drill-string inner tube by the introduction of compressed air into the drill string inner tube through an air injection sub located above the drill bit. Compressed air introduced into the air injection sub creates a vacuum effect at the bit face, thus forcing drill cuttings into the inner tube for delivery to the surface through the drill string inner tube.

Where very hard rock is encountered, both conventional single circulation mud rotary and flooded mud reverse circulation rotary methods become slow and expensive. Fluid or water powered fluid percussion hammers increase penetration rates in hard rocks markedly however their use has been limited to shallow or relatively narrow wells or drill holes due to the design limitations of drill strings currently in use.

Fluid hammers currently in use are either conventional single flow fluid hammers—using single tube drill strings—or dual flow fluid hammers using dual circulation drill strings, respectively. In the case of conventional single circulation fluid hammers, drilling fluid or mud is pumped through the single tube drill pipe and through the hammer, exiting at the bit face, with cuttings delivered to surface via the well annulus.

In the case of dual circulation fluid hammers used with dual circulation drill strings, the hammer is powered by fluid pumped through a first flow path chamber between the drill pipe inner wall and the inner tube exterior wall. Cuttings are removed via the drill hole annulus with the assistance of additional fluid pumped separately through a second flow path, that is, directly down the inner tube, with the fluids from both flow paths combining at the bit face and drill cuttings delivered to surface through the well annulus. U.S. Ser. No. 14/976,641 teaches such a dual circulation fluid hammer drilling system.

In this specification, the term fluid hammer is used to describe a down hole hammer powered by a liquid, to avoid possible confusion with a down hole hammer powered by compressed air. The term "fluid" is used to describe a "liquid", as opposed to a gas. The term water hammer used herein means a liquid or fluid powered hammer, so that the terms water hammer and fluid hammer used within this application are interchangeable and refer to the same apparatus, that is, a liquid powered hammer, as distinct from an air powered hammer.

Additionally, water when used to power a hammer may contain lubricants or certain additives to enhance hammer performance, whereupon the water may then be described as a fluid, with the term water hammer perhaps then being referred to as a fluid hammer. For the avoidance of doubt any reference herein to a water hammer or a fluid hammer shall be deemed to refer to a hammer powered by a liquid, as distinct from a hammer powered by air and any application described herein using compressed air shall be referred to as air, gas, or compressed air, as distinct from the use of the term fluid to denote air when describing a flow path through which air flows or is introduced.

The use of the word "mud" in this document shall refer to the drilling fluid pumped through a drill string and present in any drill hole or well annulus during drilling operations, commonly referred to in the industry as mud Throughout the specification unless the context requires otherwise, the word "comprise" or variations such as "comprises" or "comprising", will be understood to imply the inclusion of a stated integer or group of integers but not the exclusion of any other integer or group of integers.

SUMMARY OF INVENTION

All of the arrangements described above are challenged in situations where the cuttings have a high specific gravity or where the drilling operation is conducted in hard rock types or at greater depth or where the removal of cuttings through the well annulus in large diameter holes is constrained. It is an object of the invention to provide a drill assembly that can overcome such problems, or at least provide greater efficiency in normal drilling operations than hitherto known drill assemblies.

In accordance with one aspect of the present invention there is provided a drill assembly having at least one or preferably a plurality of drill rods connectable in series, and having a cuttings conduit to evacuate drill cuttings therealong, a liquid passage to transport drilling liquid therealong, and a gas passage to transport gas therealong; said drill rods having connectors connecting said cuttings conduit, said liquid passage, and said gas passage between connected said drill rods and maintaining fluid separation of said cuttings conduit, said liquid passage, and said gas passage from each other;

said drill assembly having a gas injector sub-assembly connectable to an end of a said drill rod between said drill rod and a drilling component, said gas injector sub-assembly having a sub-assembly cuttings conduit to evacuate drill cuttings therealong received from said drilling component, to said cuttings conduit, a sub-assembly liquid passage to transport a drilling liquid therealong received from said liquid passage to said drilling component, and a sub-assembly gas passage to introduce gas to at least one port located within said gas injector sub-assembly extending between said sub-assembly gas passage and said sub-assembly cuttings conduit;

said drill assembly having an entry sub-assembly driven by a drill rig rotary head and connectable to an end of a said drill rod spaced away from said gas injector sub-assembly; said entry sub assembly having a stator with a pressurised liquid inlet and a pressurised gas inlet connecting through a rotary mechanism to said liquid passage and said gas passage respectively; said entry sub-assembly having an entry sub-assembly cuttings conduit to evacuate drill cuttings.

Preferably each of said drill rods comprises an outer drill rod body with a proximal connector at one end and a distal connector at an opposite end, said drill rods being connectable in a string by said proximal connector of one said drill rod and said distal connector of another said drill rod to form a connection between each of said drill rods; said connection connecting said cuttings conduit, said liquid passage, and said gas passage between connected said drill rods and maintaining separation of said cuttings conduit, said liquid passage, and said gas passage from each other.

Preferably said gas injector sub-assembly has an outer sub-assembly body with a proximal sub-assembly connector at one end and a distal drill assembly connector at an opposite end; said gas injector sub-assembly being connectable by said proximal sub-assembly connector to a said distal connector of said string to form a gas injector sub-assembly connection; said gas injector sub-assembly connection connecting said sub-assembly cuttings conduit with said cuttings conduit, said sub-assembly liquid passage with said liquid passage, and said sub-assembly gas passage with said gas passage, and maintaining separation of said cuttings conduit and said liquid passage from each other; said distal drill assembly connector communicating said sub-assembly cuttings conduit and said sub-assembly liquid passage with respective drill assembly cuttings and liquid connections.

Preferably said gas passage includes at least one spacer with a plurality of apertures therein, located between an inner wall extending around said cuttings conduit and an inside of a concentric wall extending around said inner wall defining said gas passage; and said liquid passage also includes at least one spacer with a plurality of apertures therein, located between an outside of said concentric wall and said outer drill rod body.

Preferably said inner wall is expanded at an end of said cuttings conduit, to allow connecting said inner wall of connected drill rods to join by telescoping inner walls.

Preferably said concentric wall is expanded at an end of said cuttings conduit, to allow connecting said connecting wall of connected drill rods to join by telescoping concentric walls.

In accordance with a second aspect of the present invention there is provided a drill assembly having at least one or preferably a plurality of drill rods, each of said drill rods comprising an outer drill rod body with a proximal connector at one end and a distal connector at an opposite end, a cuttings conduit to evacuate drill cuttings therealong, a liquid passage to transport drilling liquid therealong, and a gas passage to transport gas therealong; said drill rods being connectable in a string by said proximal connector of one said drill rod and said distal connector of another said drill rod to form a connection between each of said drill rods; said connection connecting said cuttings conduit, said liquid passage, and said gas passage between connected said drill rods and maintaining fluid separation of said cuttings conduit, said liquid passage, and said gas passage from each other;

said drill assembly having a gas injector sub-assembly having an outer sub-assembly body with a proximal sub-assembly connector at one end and a distal drill assembly connector at an opposite end, a sub-assembly cuttings conduit to evacuate drill cuttings therealong, a sub-assembly liquid passage to transport a drilling liquid therealong, and a sub-assembly gas passage to introduce gas, and at least one port extending between said sub-assembly gas passage and said sub-assembly cuttings conduit to introduce gas from said sub-assembly gas passage to said sub-assembly cuttings conduit; said gas injector sub-assembly being connectable by said proximal sub-assembly connector to a said distal connector of said string to form a gas injector sub-assembly connection; said gas injector sub-assembly connection connecting said sub-assembly cuttings conduit with said cuttings conduit, said sub-assembly liquid passage with said liquid passage, and said sub-assembly gas passage with said gas passage, and maintaining separation of said cuttings conduit and said liquid passage from each other; said distal drill assembly connector communicating said sub-assembly cuttings conduit and said sub-assembly liquid passage with respective drill assembly cuttings and liquid connections;

said drill assembly having an entry sub-assembly connectable to a said proximal connector by a complimentary connector, and driven by a drill rig rotary head; said entry sub assembly having a stator with a pressurised liquid inlet and a pressurised gas inlet connecting through a rotary mechanism to said liquid passage and said gas passage respectively via said complimentary connector and said proximal connector; said entry sub-assembly having an entry sub-assembly cuttings conduit to evacuate drill cuttings.

Preferably said cuttings conduit extends centrally and coaxially with said outer drill rod body.

Preferably said sub assembly cuttings conduit extends centrally and coaxially with said outer sub-assembly body.

Preferably said entry sub assembly cuttings conduit extends centrally and coaxially with said stator.

Preferably said liquid passage and said gas passage extend longitudinally between said cuttings conduit and said outer drill rod body.

Preferably said sub-assembly liquid passage and said sub-assembly gas passage extend between said sub-assembly cuttings conduit and said outer sub-assembly body.

Preferably said gas passage extends concentrically around said cuttings conduit, and said liquid passage extends concentrically around said gas passage, along the inside of said outer drill rod body.

Preferably said sub-assembly gas passage extends concentrically around said sub-assembly cuttings conduit, and said sub-assembly liquid passage extends concentrically around a part of the length of said sub-assembly gas passage, along the inside of said outer sub-assembly body.

Preferably said gas passage includes at least one spacer with a plurality of apertures therein, located between an inner wall extending around said cuttings conduit and an inside of a concentric wall extending around said inner wall defining said gas passage; and said liquid passage also includes at least one spacer with a plurality of apertures therein, located between an outside of said concentric wall and said outer drill rod body.

Preferably said inner wall is expanded at an end of said cuttings conduit, to allow connecting said inner wall of connected drill rods to join by telescoping inner walls.

Preferably said concentric wall is expanded at an end of said cuttings conduit, to allow connecting said connecting wall of connected drill rods to join by telescoping concentric walls.

In accordance with a third aspect of the present invention there is provided at least one or preferably a plurality of drill rods connectable in series, and having a cuttings conduit to evacuate drill cuttings therealong, a liquid passage to transport drilling liquid therealong, and a gas passage to transport gas therealong; said drill rods having connectors connecting said cuttings conduit, said liquid passage, and said gas passage between connected said drill rods and maintaining fluid separation of said cuttings conduit, said liquid passage, and said gas passage from each other.

Preferably each of said drill rods comprises an outer drill rod body with a proximal connector at one end and a distal connector at an opposite end, said drill rods being connectable in a string by said proximal connector of one said drill rod and said distal connector of another said drill rod to form a connection between each of said drill rods; said connection connecting said cuttings conduit, said liquid passage, and said gas passage between connected said drill rods and maintaining separation of said cuttings conduit, said liquid passage, and said gas passage from each other.

Preferably said cuttings conduit extends centrally and coaxially with said outer drill rod body.

Preferably said liquid passage and said gas passage extend longitudinally between said cuttings conduit and said outer drill rod body.

Preferably said gas passage extends concentrically around said cuttings conduit, and said liquid passage extends concentrically around said gas passage, along the inside of said outer drill rod body.

Preferably said gas passage includes at least one spacer with a plurality of apertures therein, located between an inner wall extending around said cuttings conduit and an inside of a concentric wall extending around said inner wall defining said gas passage; and said liquid passage also includes at least one spacer with a plurality of apertures therein, located between an outside of said concentric wall and said outer drill rod body.

Preferably said inner wall is expanded at an end of said cuttings conduit, to allow connecting said inner wall of connected drill rods to join by telescoping inner walls.

Preferably said concentric wall is expanded at an end of said cuttings conduit, to allow connecting said connecting wall of connected drill rods to join by telescoping concentric walls.

In accordance with a fourth aspect of the present invention, there is provided, in a drill assembly having at least one or preferably a plurality of drill rods connectable in series, and having a cuttings conduit to evacuate drill cuttings therealong, and a liquid passage to transport drilling liquid therealong: a gas passage to transport gas therealong; said drill rods having connectors connecting said cuttings conduit, said liquid passage, and said gas passage between connected said drill rods and maintaining fluid separation of said cuttings conduit, said liquid passage, and said gas passage from each other;

said drill assembly having a gas injector sub-assembly connectable to an end of a said drill rod between said drill rod and a drilling component, said gas injector sub-assembly having a sub-assembly cuttings conduit to evacuate drill cuttings therealong received from said drilling component, to said cuttings conduit, a sub-assembly liquid passage to transport a drilling liquid therealong received from said liquid passage to said drilling component, and a sub-assembly gas passage to introduce gas to at least one port located within said gas injector sub-assembly extending between said sub-assembly gas passage and said sub-assembly cuttings conduit;

said drill assembly having an entry sub-assembly driven by a drill rig rotary head and connectable to an end of a said drill rod spaced away from said gas injector sub-assembly; said entry sub assembly having a stator with a pressurised liquid inlet and a pressurised gas inlet connecting through a rotary mechanism to said liquid passage and said gas passage respectively; said entry sub-assembly having an entry sub-assembly cuttings conduit to evacuate drill cuttings.

Preferably each of said drill rods comprises an outer drill rod body with a proximal connector at one end and a distal connector at an opposite end, said drill rods being connectable in a string by said proximal connector of one said drill rod and said distal connector of another said drill rod to form a connection between each of said drill rods; said connection connecting said cuttings conduit, said liquid passage, and said gas passage between connected said drill rods and maintaining separation of said cuttings conduit, said liquid passage, and said gas passage from each other.

Preferably said gas injector sub-assembly has an outer sub-assembly body with a proximal sub-assembly connector at one end and a distal drill assembly connector at an opposite end; said gas injector sub-assembly being connectable by said proximal sub-assembly connector to a said distal connector of said string to form a gas injector sub-assembly connection; said gas injector sub-assembly connection connecting said sub-assembly cuttings conduit with said cuttings conduit, said sub-assembly liquid passage with said liquid passage, and said sub-assembly gas passage with said gas passage, and maintaining separation of said cuttings conduit and said liquid passage from each other; said distal drill assembly connector communicating said sub-assembly cuttings conduit and said sub-assembly liquid passage with respective drill assembly cuttings and liquid connections.

Preferably said gas passage includes at least one spacer with a plurality of apertures therein, located between an inner wall extending around said cuttings conduit and an inside of a concentric wall extending around said inner wall defining said gas passage; and said liquid passage also includes at least one spacer with a plurality of apertures therein, located between an outside of said concentric wall and said outer drill rod body.

Preferably said inner wall is expanded at an end of said cuttings conduit, to allow connecting said inner wall of connected drill rods to join by telescoping inner walls.

Preferably said concentric wall is expanded at an end of said cuttings conduit, to allow connecting said connecting wall of connected drill rods to join by telescoping concentric walls.

In accordance with a fifth aspect of the present invention, there is provided a method of drilling a bore hole comprising providing a drill assembly having at least one or preferably a plurality of drill rods connectable in series, each of said drill rods having a cuttings conduit connectable in series to evacuate drill cuttings therealong, a liquid passage connectable in series to transport drilling liquid therealong, and a gas passage connectable in series to transport gas therealong; said drill rods having connectors connecting said cuttings conduit, said liquid passage, and said gas passage between connected said drill rods and maintaining fluid separation of said cuttings conduit, said liquid passage, and said gas passage from each other;

providing in said drill assembly, a gas injector sub-assembly connectable to an end of a said drill rod between said drill rod and a drilling component, said gas injector sub-assembly having a sub-assembly cuttings conduit to evacuate drill cuttings therealong received from said drilling component, to said cuttings conduit, a sub-assembly liquid passage to transport a drilling liquid therealong received from said liquid passage to said drilling component, and a sub-assembly gas passage to introduce gas to at least one port located within said gas injector sub-assembly extending between said sub-assembly gas passage and said sub-assembly cuttings conduit;

providing in said drill assembly, an entry sub-assembly driven by a drill rig rotary head and connectable to an end of a said drill rod spaced away from said gas injector sub-assembly; said entry sub assembly having a stator with a pressurised liquid inlet and a pressurised gas inlet connecting through a rotary mechanism to said liquid passage and said gas passage respectively; said entry sub-assembly having an entry sub-assembly cuttings conduit to evacuate drill cuttings;

delivering liquid under pressure to said pressurised liquid inlet and down said liquid passage to said drilling component, evacuating drill cuttings up said cuttings conduit from said drilling component, and delivering gas under pressure into said pressurised gas inlet and down said gas passage where the gas under pressure enters said cuttings conduit in said gas injector sub assembly to provide lift to cuttings and liquid slurry contained in said cuttings conduit.

Preferably, in said method, each of said drill rods comprises an outer drill rod body with a proximal connector at one end and a distal connector at an opposite end, said drill rods being connectable in a string by said proximal connector of one said drill rod and said distal connector of another said drill rod to form a connection between each of said drill rods; said connection connecting said cuttings conduit, said liquid passage, and said gas passage between connected said drill rods and maintaining separation of said cuttings conduit, said liquid passage, and said gas passage from each other.

Preferably, in said method, said gas injector sub-assembly has an outer sub-assembly body with a proximal sub-assembly connector at one end and a distal drill assembly connector at an opposite end; said gas injector sub-assembly being connectable by said proximal sub-assembly connector to a said distal connector of said string to form a gas injector sub-assembly connection; said gas injector sub-assembly connection connecting said sub-assembly cuttings conduit with said cuttings conduit, said sub-assembly liquid passage with said liquid passage, and said sub-assembly gas passage with said gas passage, and maintaining separation of said cuttings conduit and said liquid passage from each other; said distal drill assembly connector communicating said sub-assembly cuttings conduit and said sub-assembly liquid passage with respective drill assembly cuttings and liquid connections.

Preferably, in said method, said gas passage includes at least one spacer with a plurality of apertures therein, located between an inner wall extending around said cuttings conduit and an inside of a concentric wall extending around said inner wall defining said gas passage; and said liquid passage also includes at least one spacer with a plurality of apertures therein, located between an outside of said concentric wall and said outer drill rod body.

Preferably, in said method, said inner wall is expanded at an end of said cuttings conduit, to allow connecting said inner wall of connected drill rods to join by telescoping inner walls.

Preferably, in said method, said concentric wall is expanded at an end of said cuttings conduit, to allow connecting said connecting wall of connected drill rods to join by telescoping concentric walls.

In accordance with a sixth aspect of the present invention, there is provided a method of drilling a bore hole comprising providing a drill assembly having a drill rig rotary head located outside said bore hole, driving a drill string having a drilling component at a distal end thereof, said drill string being formed of a plurality of drill rods connectable in series as drilling proceeds; injecting liquid from a first rotary connector located proximal to said drill rig rotary head, through a liquid passage along said drill string to drill assembly; ejecting cuttings from said drill assembly through a cuttings conduit extending along said drill string; injecting gas under pressure through a second rotary connector located proximal to said drill rig rotary head, through a gas passage along said drill string to a location adjacent to said drill assembly proximal to the end of said drill string where said gas under pressure is introduced into said cuttings conduit to assist in evacuating the cuttings and liquid slurry along said cuttings conduit.

In all of the above described arrangements the cuttings conduit evacuates cuttings from the drilling component, up the drill string formed by the drill rods to be delivered usually to the surface of the drilling operation, counter current to the liquid and gas which are delivered via the liquid passage and the gas passage respectively down the drill string. The drilling component may be a drill bit or a drill bit with a hammer mechanism, and the liquid is delivered to the drill bit, where cuttings are entrained and evacuated toward the entry of the sub-assembly cuttings conduit and/or the cuttings conduit.

The liquid may be a drilling fluid such as a drilling mud or may be water, which is pumped down the liquid passage.

The gas may be air, particularly supplied under pressure/as compressed air, which is supplied down the gas passage. The compressed air is introduced into the cuttings being evacuated from the drilling component, through ports connecting the gas passage to the cuttings conduit in the gas injector sub-assembly (connecting the sub-assembly gas passage to the sub-assembly cuttings conduit), from where it assists in lifting the drilling cuttings up the cuttings conduit, and assists in drawing the cuttings from the cutting surfaces of the drilling component.

Generally, the drilling component is of a greater diameter than the diameter of the drill string (the diameter of each drill rod or the diameter of the cuttings conduits), resulting in an anulus around the drill string (the well annulus), which would normally be flooded with water/mud during the drilling operation.

The invention provides a triple tube drill rod system comprising one or more drill rods which when coupled together form a drill string having three separate fluid paths, each performing a specific function.

The up-hole end of the drill string is attached to a drill rig rotary head having a hollow spindle and the down hole end the drill string is attached to the drilling component, which may be either a reverse circulation rotary drill bit, reverse circulation hole opening bit assembly, a conventional water or fluid hammer or a reverse circulation water or fluid hammer.

The triple tube, triple circulation drill string according to the invention has advantages over existing single circulation or dual circulation drill string systems, including but not limited to more rapid penetration rates in hard rocks and more effective removal of drill cuttings, especially in large diameter wells where rapid and effective removal of cuttings can occur through the cuttings conduit/drill string inner tube when assisted by compressed air pumped into the sub-assembly injector cuttings conduit in the gas injector sub-assembly. The combination of high-pressure water ejected at the drill bit face plus the vacuum effect created by compressed air pumped into the gas injector sub-assembly, assisted by static pressure from mud or drilling fluid in the annulus surrounding the outer drill bodies (between the bored hole and the drill string) acting downwards, results in highly effective cuttings removal through the cuttings conduits of the serially joined drill rods.

While it is most preferred that the gas passage is arranged concentrically around the central cuttings conduit, and the liquid passage is arranged concentrically around the gas passage, in an alternative embodiment the liquid passage could be arranged concentrically around the central cuttings conduit, and the gas passage could be arranged concentrically around the liquid passage. In further alternative arrangements separate multiple ducts may be provided for the liquid passages and/or separate multiple ducts may be provided for the gas passages. For reasons of balance primarily, it is most preferred that the cuttings conduit is arranged centrally within the drill rods.

BRIEF DESCRIPTION OF DRAWINGS

In order to provide a better understanding, preferred embodiments of the present invention will be described, by way of example only, with reference to the accompanying drawings, in which.

DESCRIPTION OF EMBODIMENTS

Figure 15:
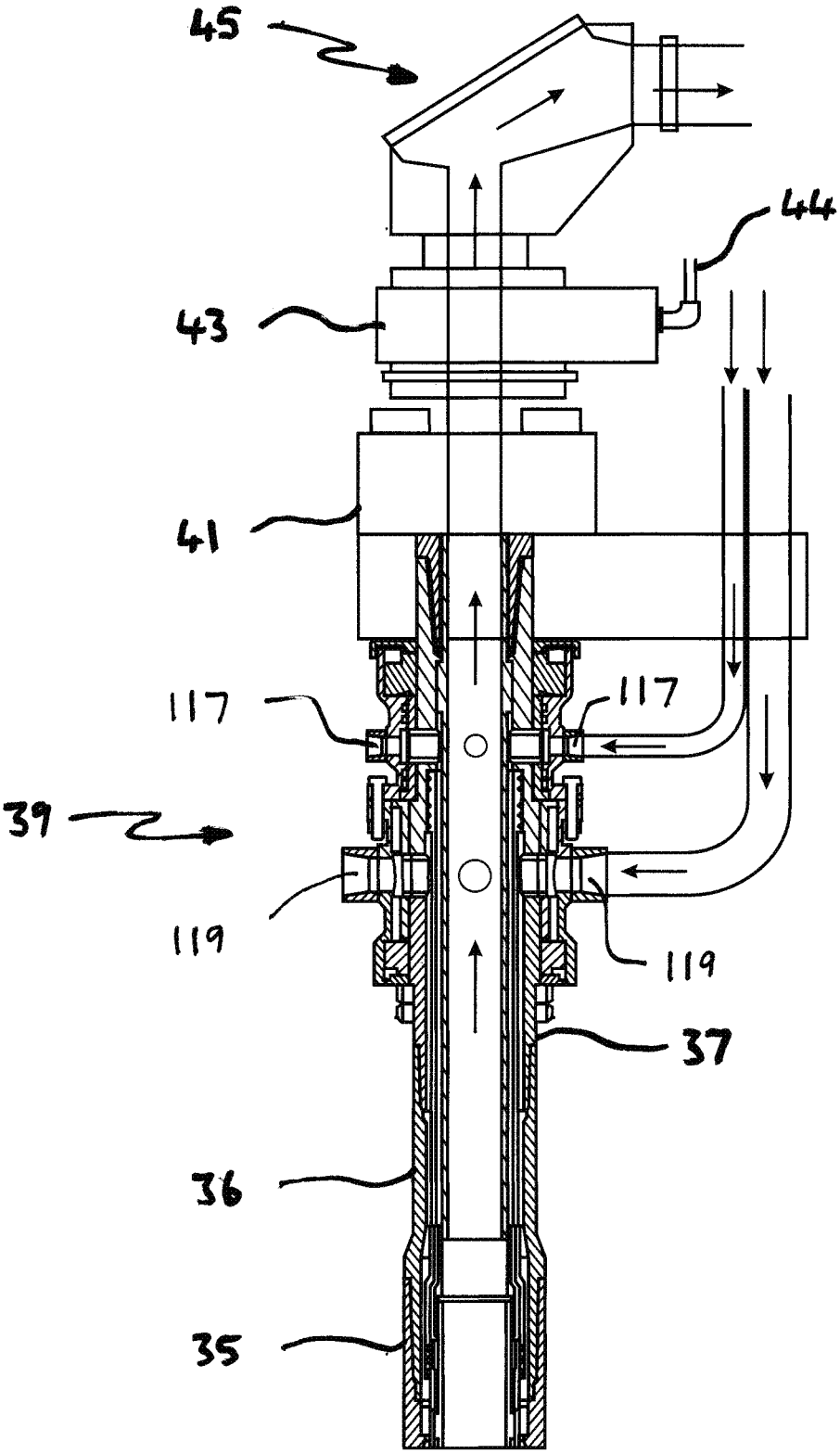
FIG. 15 is a longitudinal cross-section view of the entry sub-assembly shown in FIGS. 13 and 14, illustrated connected to an air blow down component and cuttings evacuation at the top of the drill head.
Figure 16:
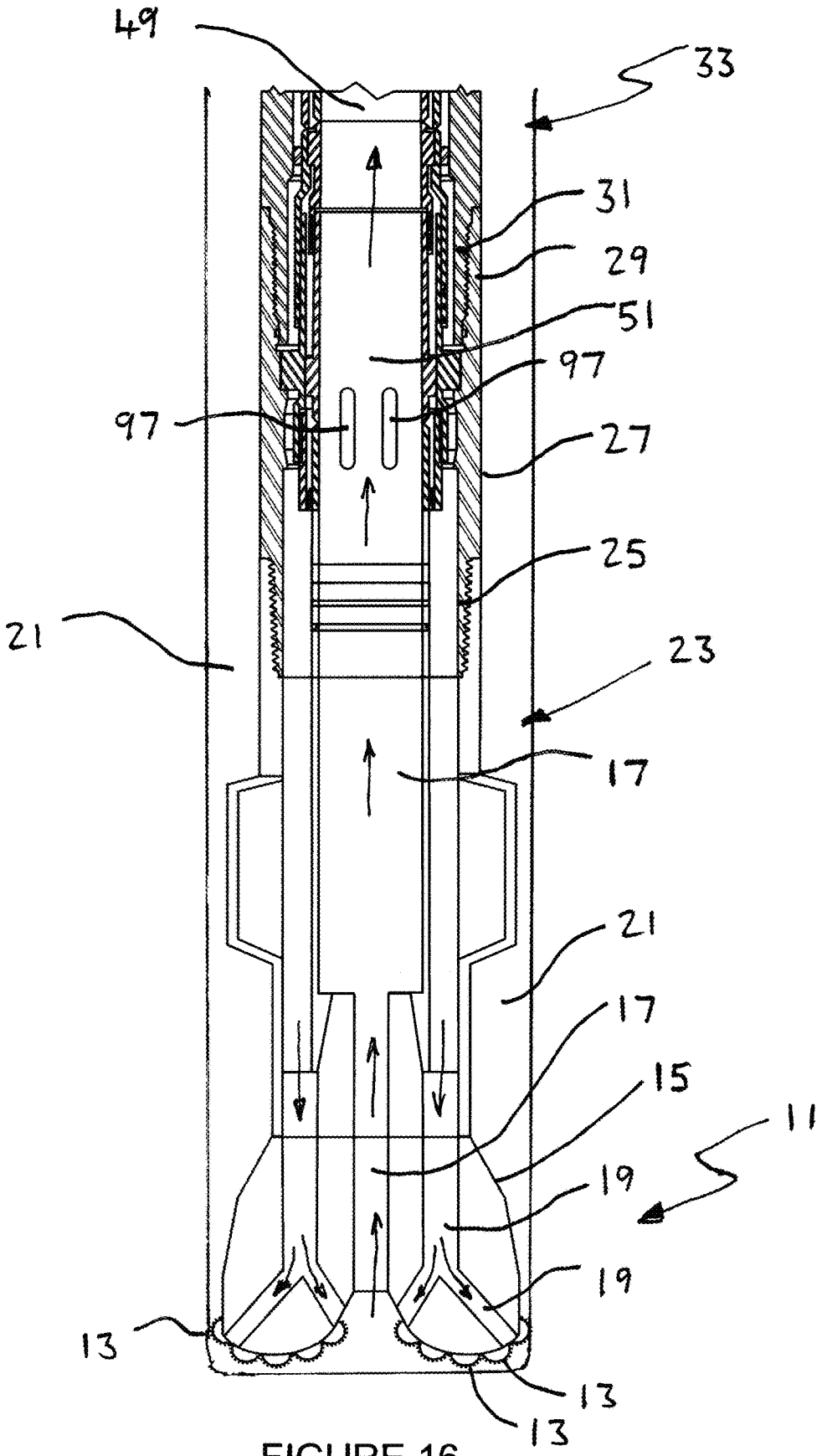
FIG. 16 is a schematic diagram showing a drill rod of FIGS. 2 and 8, with the gas injector sub-assembly of FIG. 1, coupled to a reverse circulation rotary drill bit in a first embodiment.

Referring to FIGS. 15 and 16, the components that make up a drilling assembly incorporating the invention are shown in a first embodiment. The drilling assembly includes, from the bottom in FIG. 16, a reverse circulation rotary drill bit 11 having cutting teeth 13, connected to a drill body 15. The drill body 15 has a central cuttings conduit 17 in fluid connection with the drill bit 11 and cutting teeth 13, to evacuate cuttings upward, and has a drilling fluid (liquid)/water passage 19 that is arranged concentrically around the cuttings conduit 17 to deliver drilling fluid (liquid)/water down to the drill bit 11 and cutting teeth 13. Mud is also delivered via the well annulus 21, around the outside of the drilling assembly.

In FIG. 16, the top 23 of the drill body 15 is connected to a distal connector 25 of a gas injector sub-assembly 27, which in turn is connected by its top or proximal connector 29 to a distal connector 31 of and at the bottom of a drill rod 33. The drill rod 33 has a proximal connector 35 at the top thereof (see in FIGS. 2 and 15) As drilling proceeds, further such drill rods 33 may be joined by their distal connector 31 to the top of the proximal connector 35 of the drill rod 33 that is in the hole being drilled (see in FIG. 3).

Figure 13:
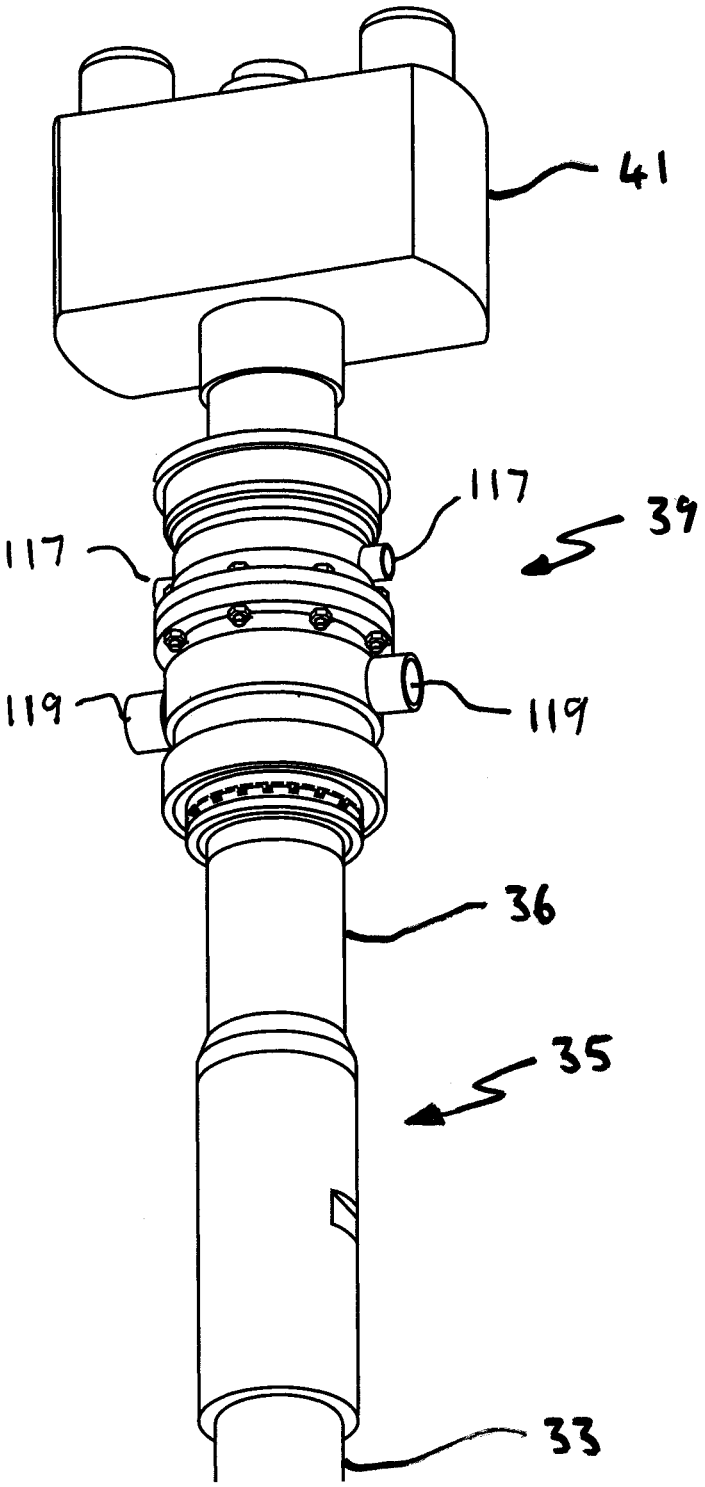
FIG. 13 is a perspective view from below of the drill rig rotary head connected above the entry sub-assembly, which is in turn connected above the top of a drill rod of FIGS. 2 and 8.

Referring to FIGS. 13 and 15, at the top of the highest drill rod 33 are the above ground components of the drilling assembly. The proximal connector 35 of the highest drill rod 33 is connected via an adaptor 36 to the bottom 37 of an entry sub-assembly 39, which has connected atop, a drill rig rotary head 41 which uses a hydraulic rotary motor (not shown, internal to the drill rig rotary head 41) to drive the drill rod 33 with a rotary motion to perform the drilling operation.

Above the drill rig rotary head 41 (see FIG. 15) is located an air or fluid blow-down injector valve 43 which is used to clear blockages in the cuttings conduit using compressed air, mud or water, selectively supplied as required by a pipe 44, and there is a deflector assembly 45 located on top, of the blow-down injector valve 43 to deflect the emerging cuttings away from the vertical (axial extent of the cuttings conduit) in a controlled manner, where they can be collected for assay if required, or otherwise disposed of.

The invention resides in the arrangements provided in the entry sub-assembly 39, the drill rods 33, and the gas injector sub-assembly 27. The arrangements of the drill body 15 and drill bit 11 located below the gas injector sub-assembly 27, and the drill rig rotary head 41, air blow-down injector 43, and deflector assembly 45 located above the entry sub-assembly 39, are conventionally used in normal ground and rock drilling.

Figure 10:
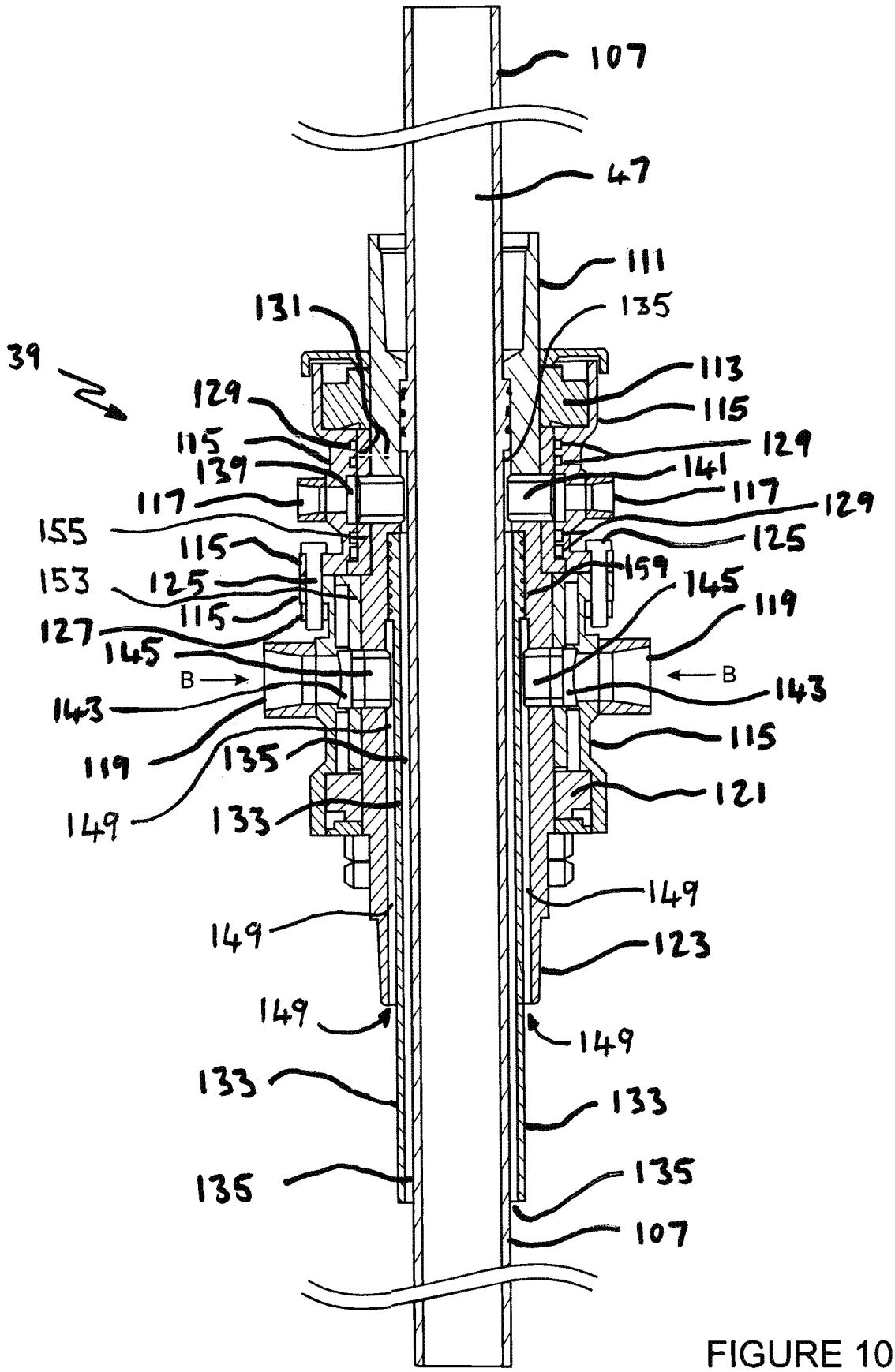
FIG. 10 is a longitudinal cross-section view through an entry sub-assembly according to all of the embodiments.
Figure 12:
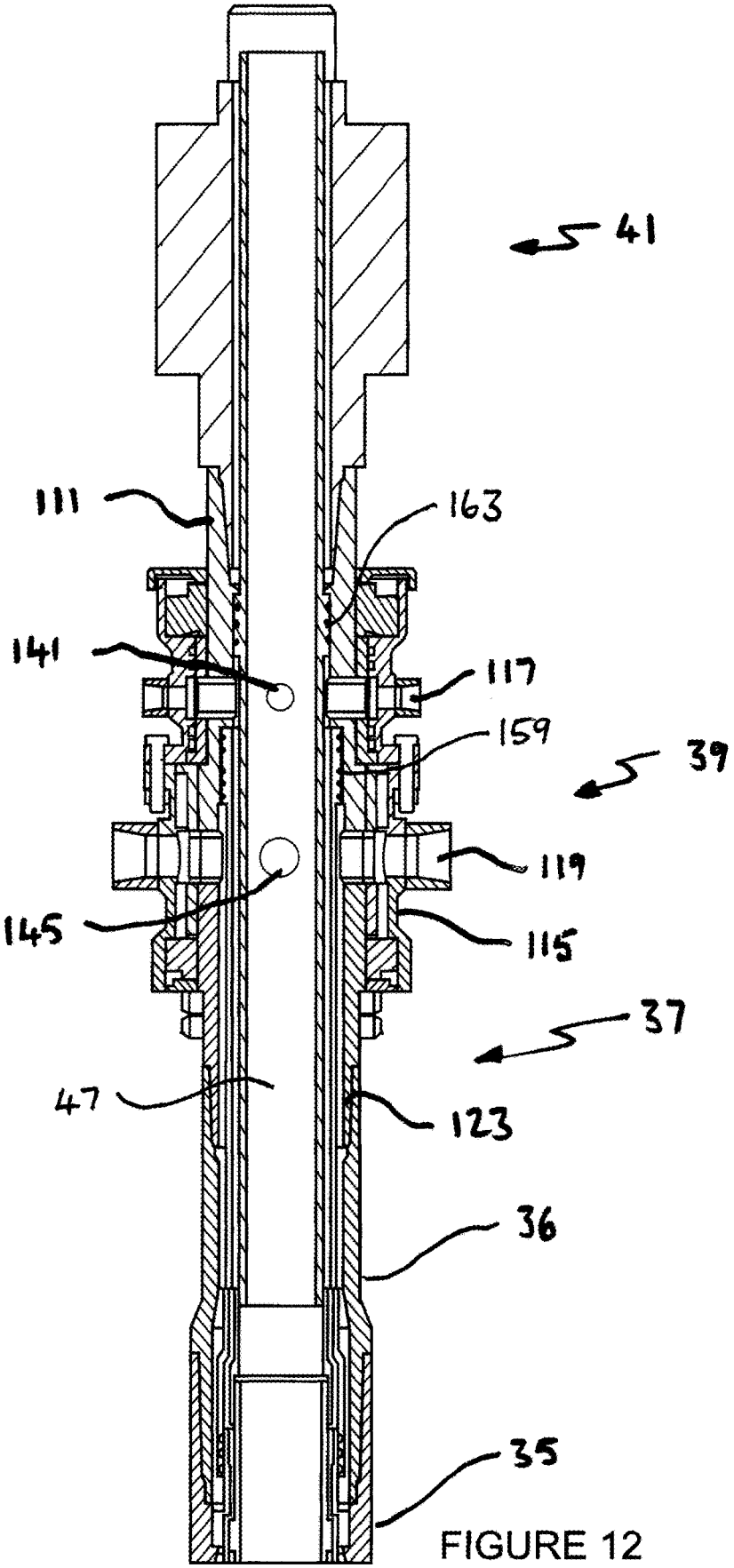
FIG. 12 is a longitudinal cross-section view through the entry sub-assembly shown in FIG. 10, with a drill rig rotary head connected above; according to all of the embodiments.
Figure 14:
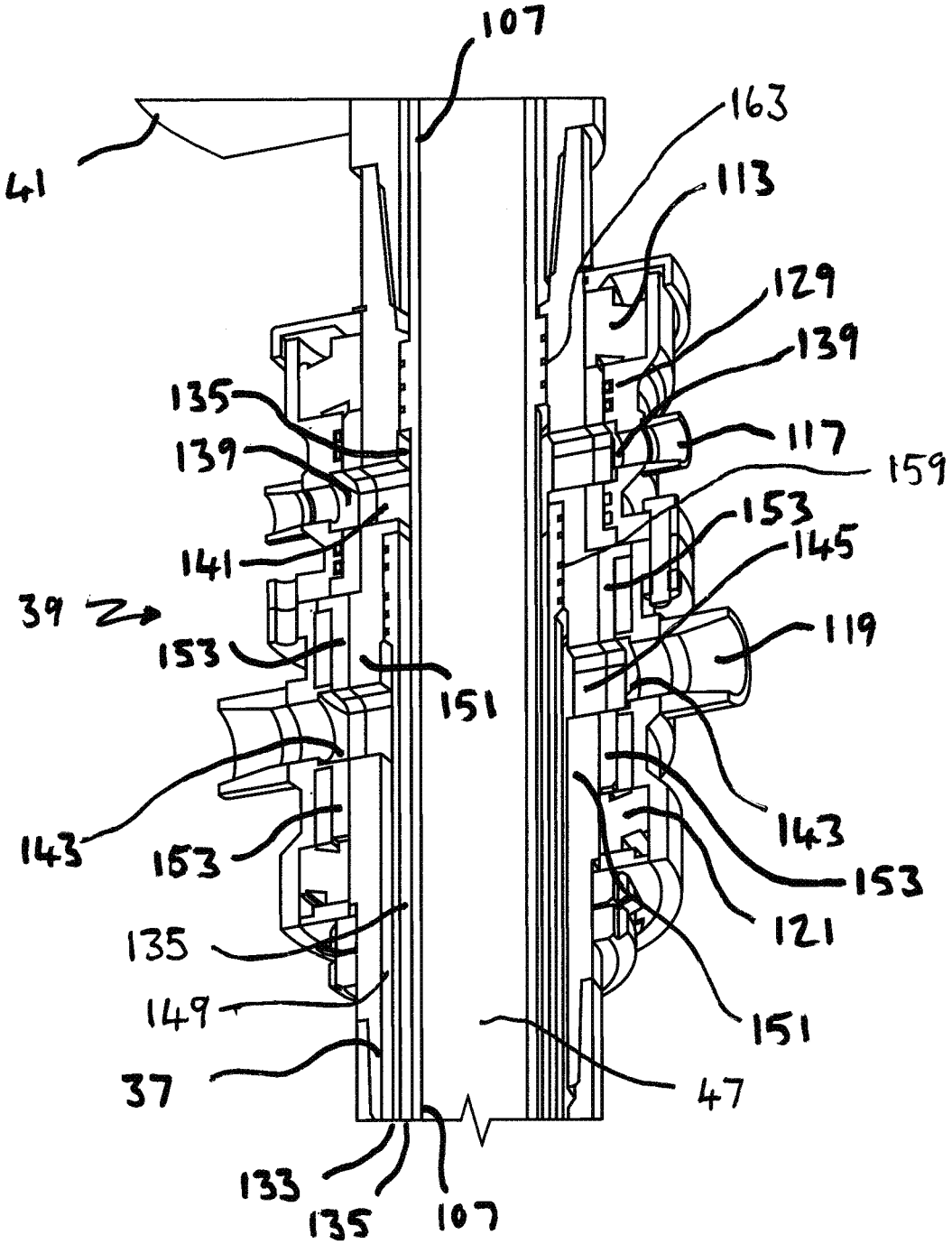
FIG. 14 is a longitudinal cut-away view of the entry sub-assembly shown in FIG. 13.

Referring to FIGS. 10, 12, and 14, the entry sub-assembly 39 is shown in greater detail. The entry sub-assembly 39 has a central cuttings conduit 47 through which drill cuttings are evacuated upward, to exit through the cuttings conduit in the drill rig rotary head 41. The central cuttings conduit 47 is arranged as a wear tube which extends through the adaptor 36 and the drill rig rotary head, to minimise wear caused by evacuated drill cuttings.

Drill Rods 33

Figure 2:
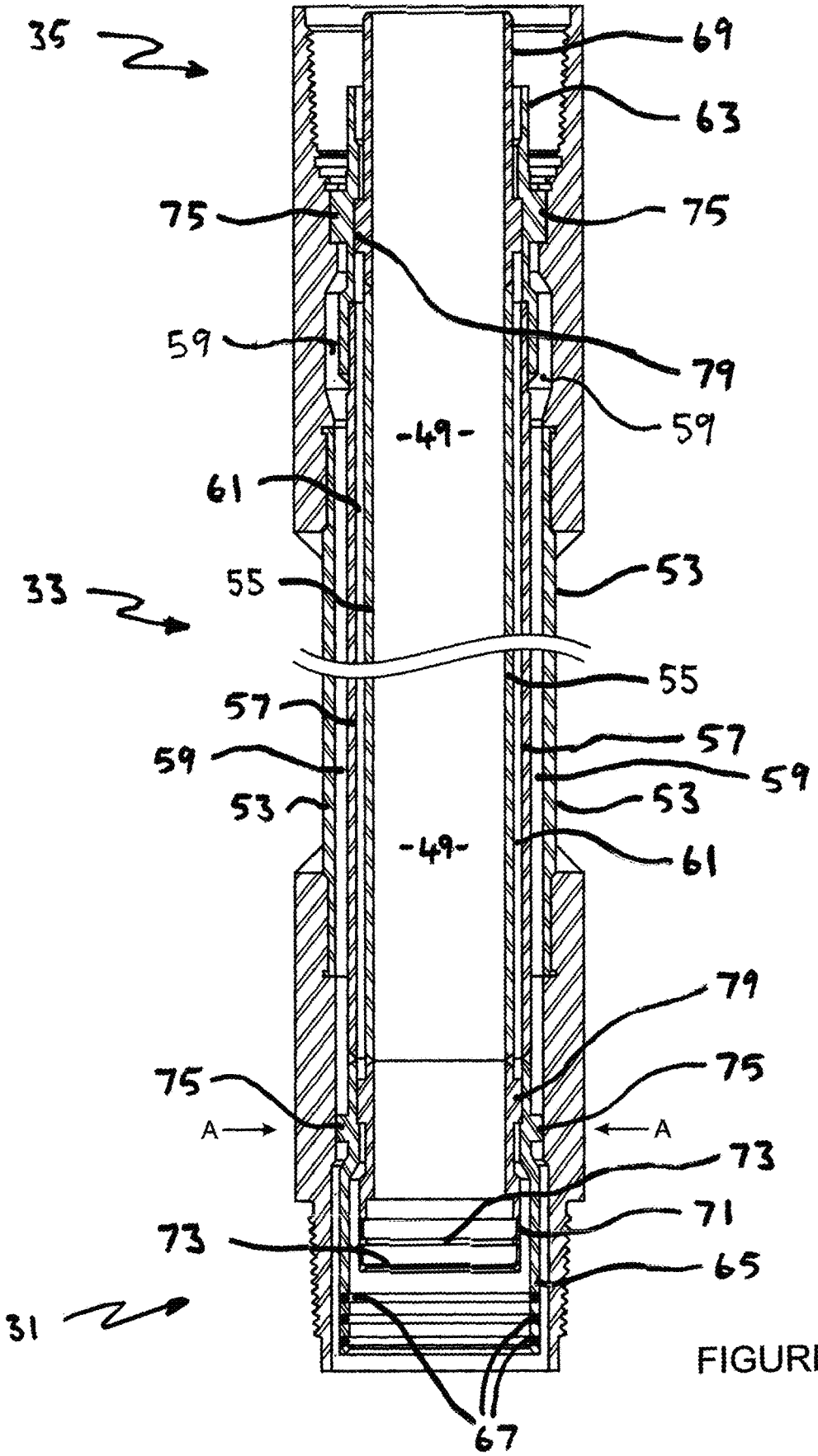
FIG. 2 is a longitudinal cross section view of a drill rod according to all of the embodiments.
Figure 3:
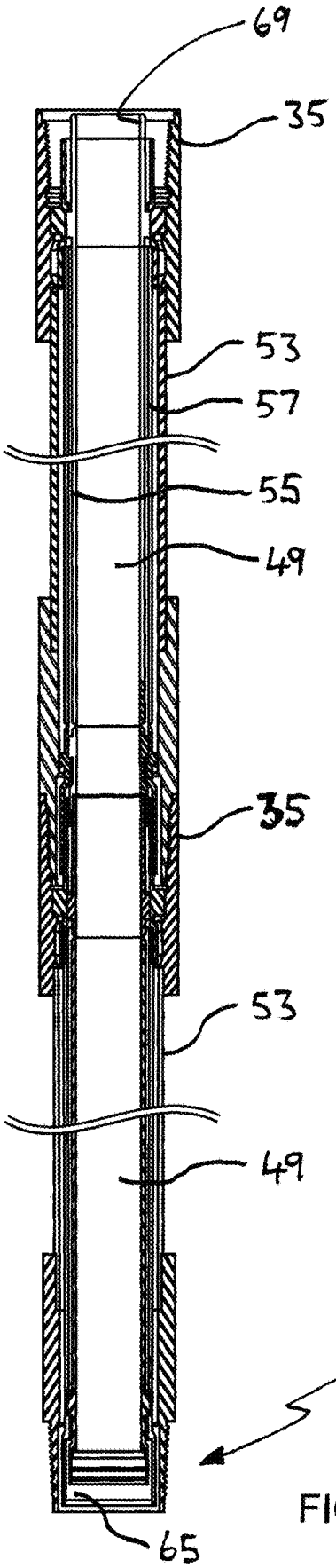
FIG. 3 is a longitudinal cross section view showing two drill rods as shown in FIG. 2, connected together.
Figure 4:
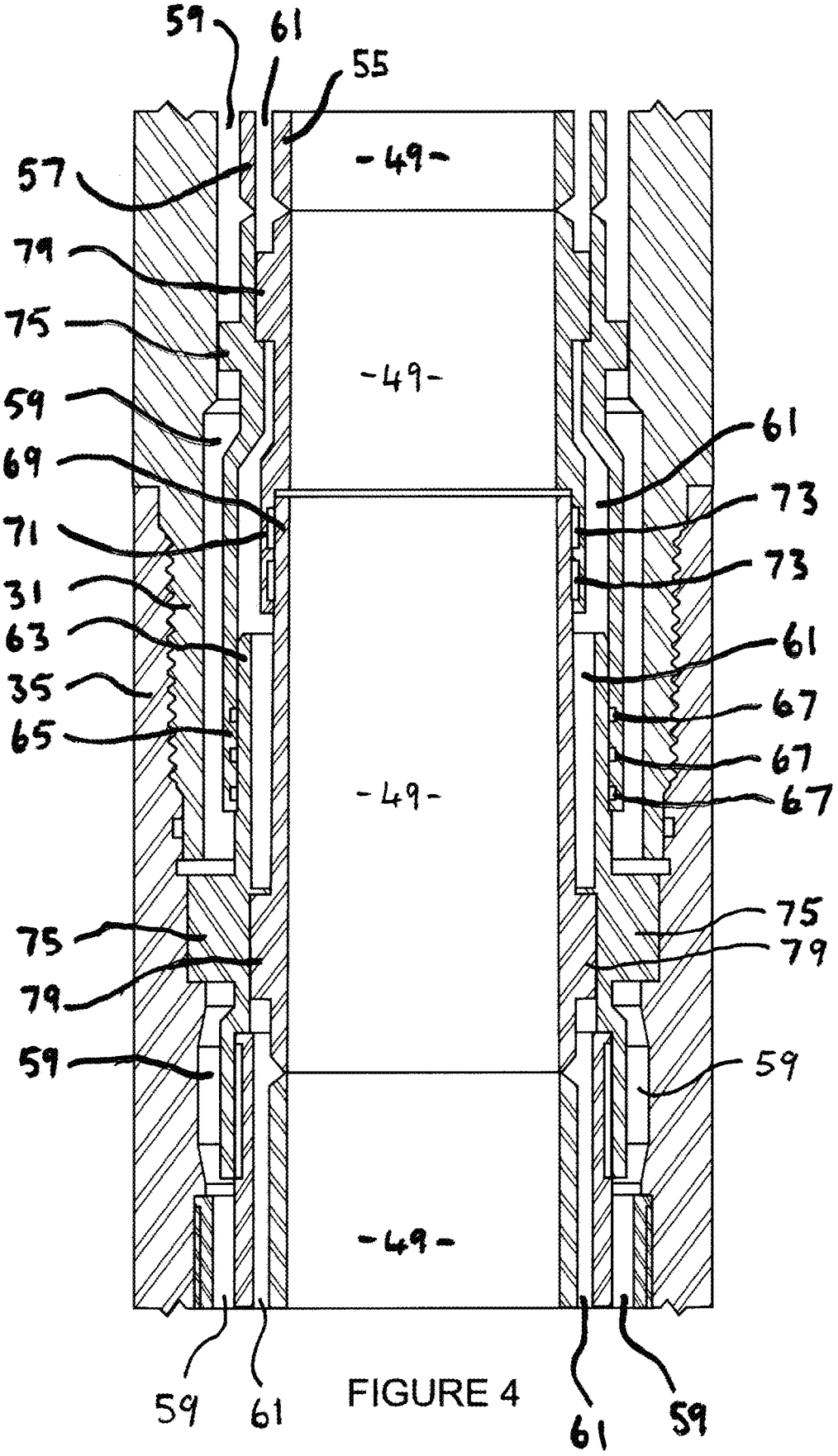
FIG. 4 is a longitudinal cross section view of distal and proximal connectors of two connected drill rods.

Referring to FIG. 4, the drill rods 33 are connectable in a string by a proximal connector 35 of one drill rod being screwed to the distal connector 31 of another drill rod 33 to form a connection between each of the drill rods 33. The proximal connector 35 and distal connector 31 have a tapered connecting thread as can be seen in FIG. 2. The centrally located tube 55 forming the cuttings conduit 49 has a male fitting 69 at the top forming part of the proximal connector 35 and a female connector 71 with embedded o-ring seals 73 at the bottom forming part of the distal connector 31. The male fitting 69 extends within the female connector 71 and the inside of the cuttings conduit 49 is sealed from the gas passage 61 by the o-ring seals 71.

The drilling assembly has initially one drill rod 33, and as drilling proceeds, a number of drill rods 33 connected together. Referring generally to FIGS. 2 to 7 but particularly to FIG. 2, each drill rod 33 has an outer cylindrical drill rod body 53 with the proximal connector 35 at the top of the drill rod 33 and the distal connector 31 at the opposite end at the bottom of the drill rod 33, the cuttings conduit 49 formed by a centrally located tube 55 to evacuate drill cuttings therealong. A coaxial tube 57 of greater diameter than the centrally located tube 55 is located extending commensurately with the tube, along the length of the drill rod 33, and provides within the drill rod 33 a liquid passage 59 located between the inside of the outer cylindrical drill rod body 53 and the outside of the coaxial tube 57, to transport drilling liquid therealong, down (usually) to the drill bit, and also provides between the inside of the coaxial tube and the outside of the centrally located tube 55, a gas passage 61 to transport gas therealong, down to the gas injector sub-assembly 27.

Referring to FIG. 4, the drill rods 33 are connectable in a string by a proximal connector 35 of one drill rod being screwed to the distal connector 31 of another drill rod 33 to form a connection between each of the drill rods 33. The proximal connector 35 and distal connector 31 have a tapered connecting thread as can be seen in FIG. 2. The centrally located tube 55 forming the cuttings conduit 49 has a male fitting 69 at the top forming part of the proximal connector 35 and a female connector 71 with embedded o-ring seals 73 at the bottom forming part of the distal connector 31. The male fitting 69 extends within the female connector 71 and the inside of the cuttings conduit 49 is sealed from the gas passage 61 by the o-ring seals 71.

The coaxial tube 57 forming the separation between the gas passage 61 and the liquid passage 59 has a male fitting 63 at the top forming part of the proximal connector 35 and a female connector 65 with embedded o-ring seals 67 at the bottom forming part of the distal connector 31. The o-ring seals 67 seal the gas passage 61 from the liquid passage 59.

Figures 5, 6, 7:
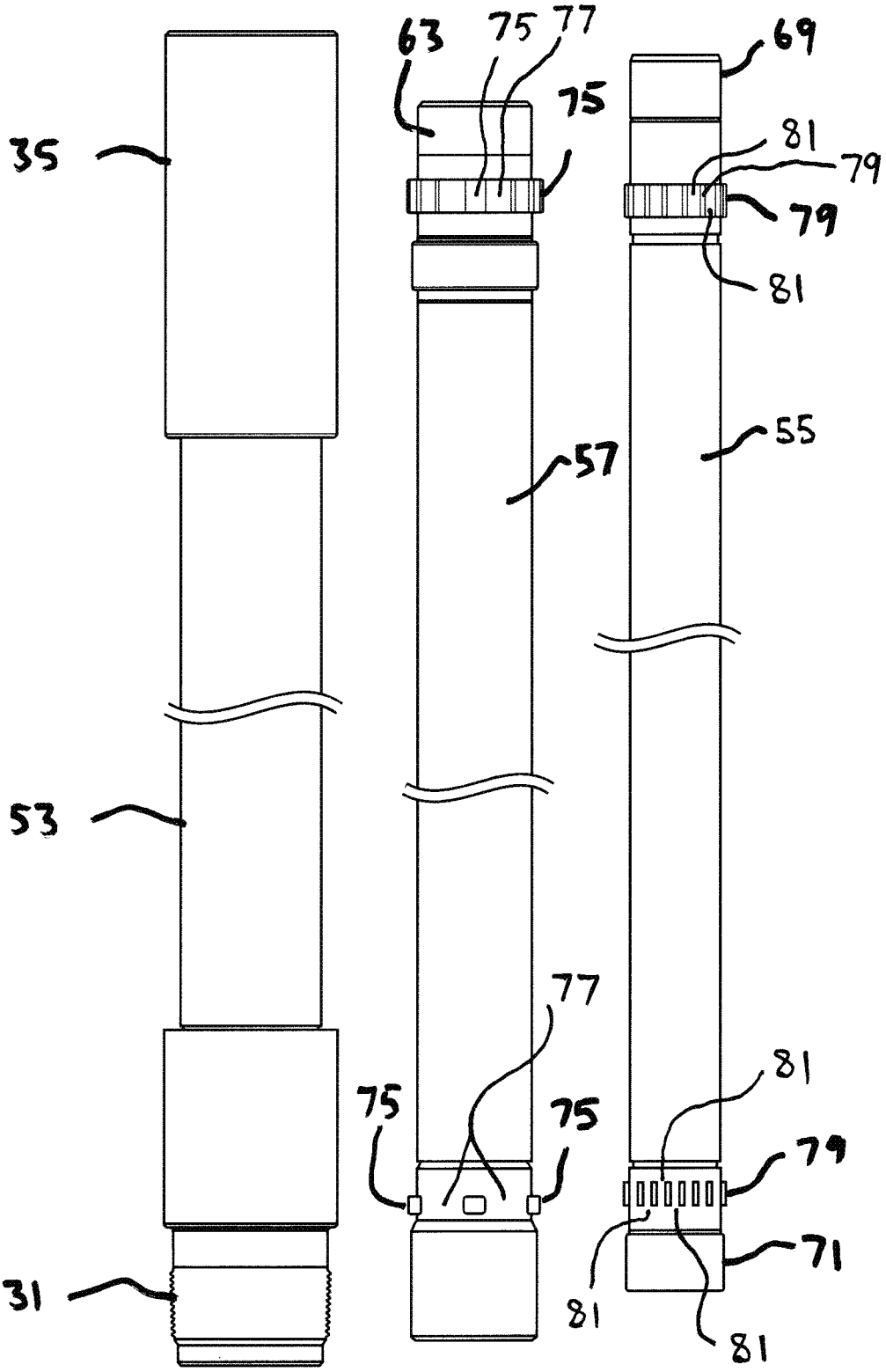
FIG. 5 is a side plan view of the outer conduit casing and proximal and distal connectors of the drill rod of FIG. 2.
FIG. 6 is a side plan view of an intermediate conduit casing enclosing the gas passage, and its proximal and distal connector components, which is contained within the outer conduit casing of the drill rod of FIG. 5.
FIG. 7 is a side plan view of an inner conduit casing enclosing and forming the cuttings conduit, and its proximal and distal connector components, which is contained within the intermediate conduit casing of the drill rod of FIG. 6.
Figure 8:
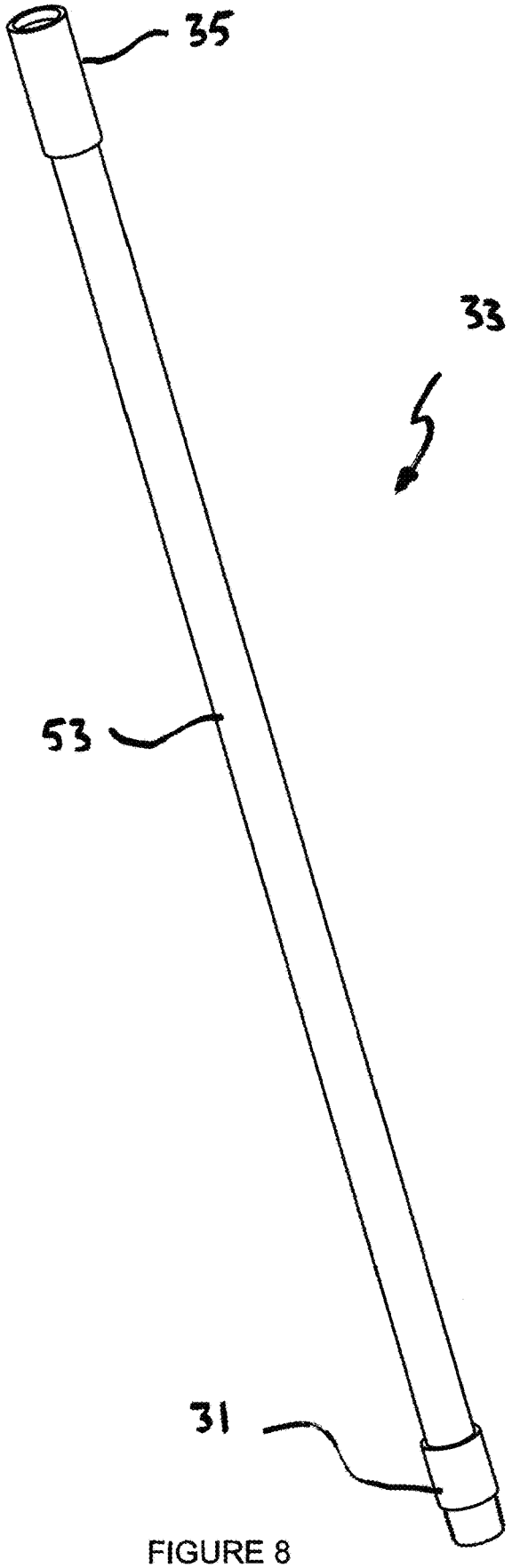
FIG. 8 is a perspective view from above, of the entire drill rod of FIG. 2.
Figure 9:
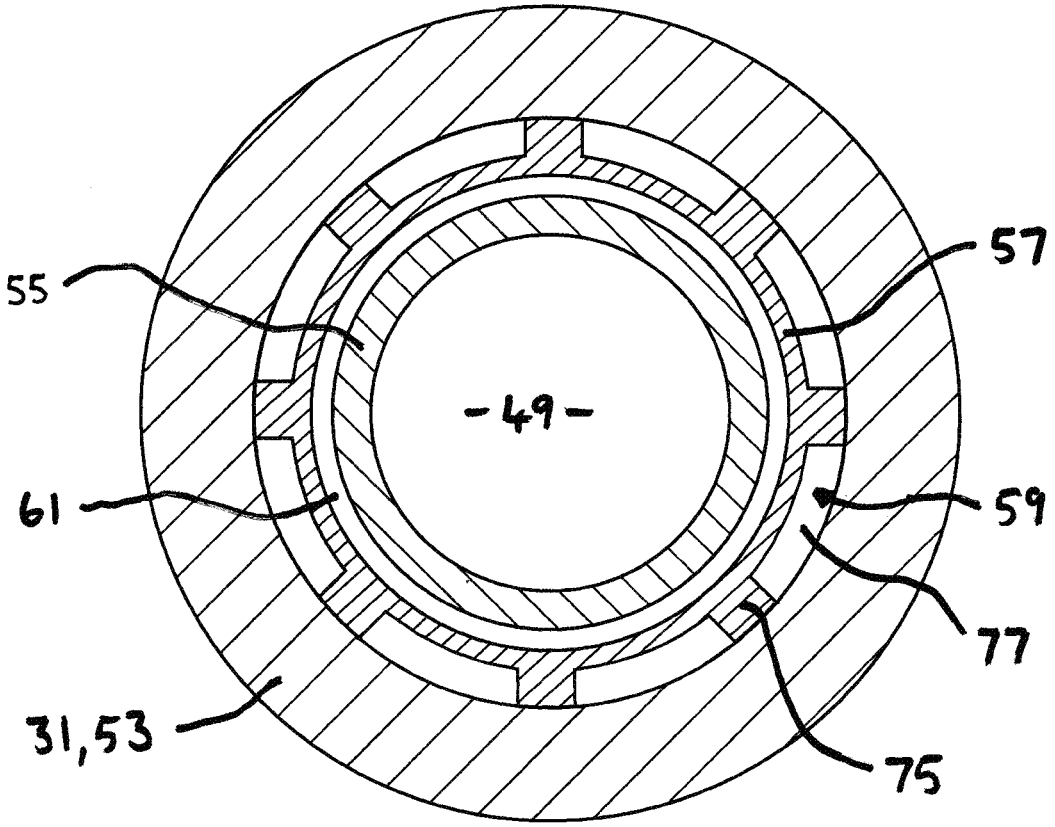
FIG. 9 is a view through transverse cross-section A-A of FIG. 2.

Referring also to FIGS. 6, 7, and 9, the coaxial tube 57 is spatially located relative to the outer cylindrical drill rod body 53 by castellated circumferential spacers 75 located near each end, the castellated circumferential spacers 75 having voids 77 that allow the passage of drilling liquid therepast. The centrally located tube 55 is spatially located relative to the coaxial tube 57 by castellated circumferential spacers 79 located near each end, the castellated circumferential spacers 79 having voids 81 that allow the passage of gas therepast.

The arrangement of the o-ring seals 67 and 73 in the respective tube joins maintains fluid separation of the cuttings conduit 49, gas passage 61, and liquid passage 59, from each other. The connectors 69 and 71, and 63 and 65 provide for passage of drill cuttings, gas, and drilling liquid between connected drill rods 33.

Gas Injector Sub-Assembly 27

Figure 1:
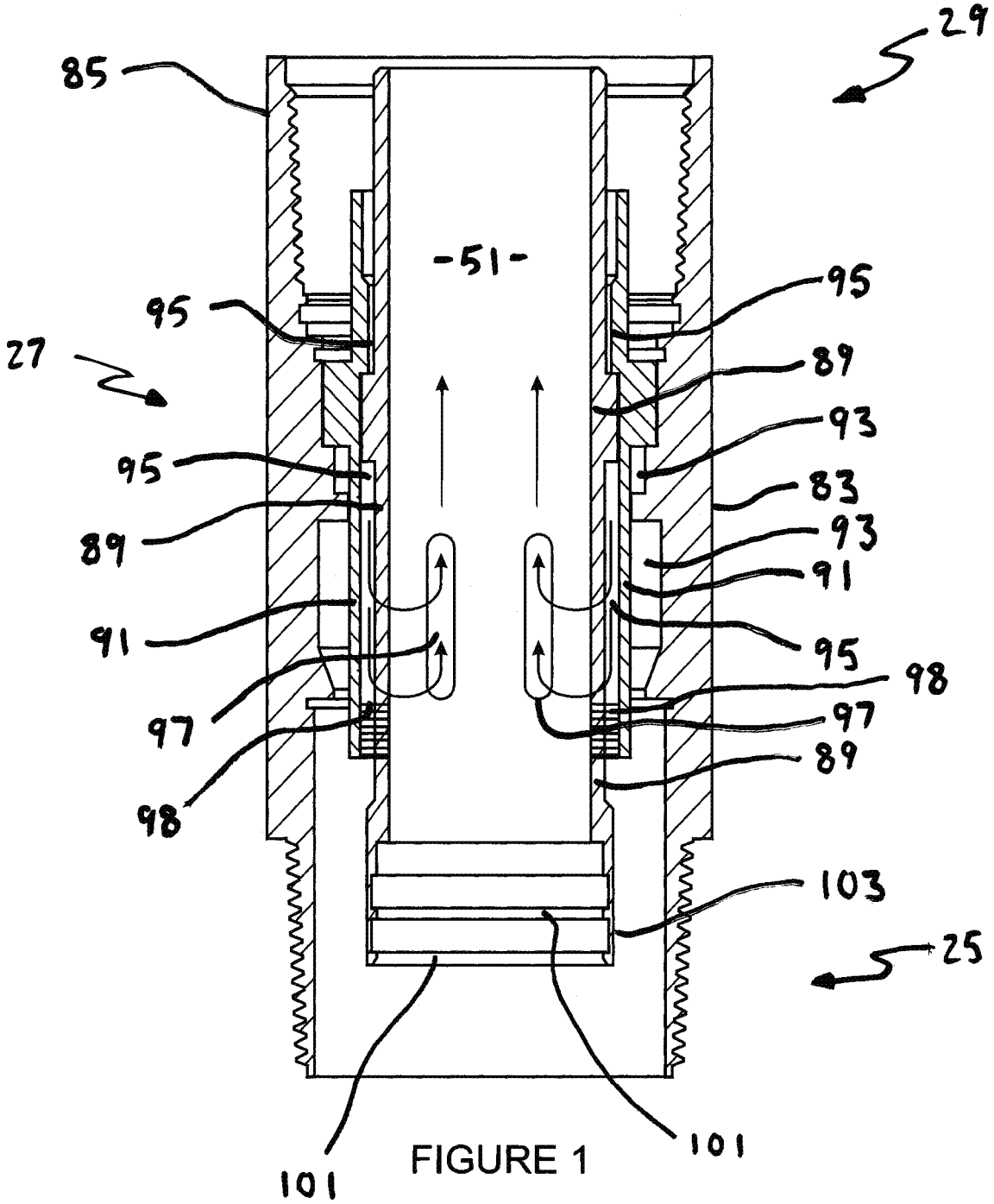
FIG. 1 is a longitudinal cross section view of a gas injector sub-assembly according to all of the embodiments.

Referring to FIG. 1, the gas injector sub-assembly 27 has an outer sub-assembly body 83 with a proximal sub-assembly connector 85 at the top end and the distal drill assembly connector 25 at the bottom end. The gas injector sub-assembly 27 has the sub-assembly cuttings conduit 51 formed by a centrally located tube 89 to evacuate drill cuttings therealong. A coaxial tube 91 of greater diameter than the centrally located tube 89 is located extending commensurately with the tube 89, along most of the upper length of the gas injector sub-assembly 27, and provides within the gas injector sub-assembly 27 a liquid passage 93 located between the inside of the outer cylindrical drill rod body 83 and the outside of the coaxial tube 91, to transport drilling liquid therealong, down (usually) to the drill bit, and also provides between the inside of the coaxial tube 91 and the outside of the centrally located tube 89, a gas passage 95 to transport gas therealong, down to at least one port in the form of four axially elongated apertures 97 spaced around the wall of the centrally located tube 89 communicating with the cuttings conduit 51, to introduce gas from said sub-assembly gas passage to said sub-assembly cuttings conduit. The gas passage terminates at a position 98 below the apertures 97. Thus, all compressed air communicated along the gas passages of the connected entry sub-assembly 39 and its adaptor 36, the connected drill rods 33 and gas injector sub-assembly 27, is directed through the apertures 97 where it enters the cuttings conduit 51 and proceeds up the drill rods 33 cuttings conduits 49, and up through the cuttings conduit 47 within the adaptor 36 and entry sub-assembly 39.

Drilling liquid, such as water is pumped down from the entry sub-assembly 39 liquid passage, through the connected drill rods 33 liquid passages 59 and through the gas injector sub-assembly 27 liquid passage 93, from where is proceeds to the drill bit 11.

The gas injector sub-assembly 27 proximal sub-assembly connector 85 is configured the same as the proximal connector 35 of the drill rods 33, so as to be connectable to the distal connector 31 of a drill rod 33, while maintaining fluid separation of the cuttings conduit gas passage and liquid passage from each other, and allowing passage of gas and drilling liquid from the connected drill rod 33 to the gas injector sub-assembly 27.

The distal drill assembly connector 87 is configured to attach to the drill body 15 and drill bit 11 (or percussive hammer mechanism as the case may be). The distal drill assembly connector 87 also includes embedded o-ring seals 101 in a female end 103 of the cuttings conduit 51 to seal the cuttings conduit from the liquid passage 93.

Entry Sub-Assembly 39

Referring to FIG. 12, the entry sub-assembly 39 connects to the proximal connector 35 of a connected drill rod 33 by a complimentary connector formed by the adaptor 36.

Referring to FIG. 10, the entry sub-assembly 39 central cuttings conduit 47 extends as a wear tube pipe 107 above connector 111 and through the drill rig rotary head 41, (see also FIGS. 12, 13, and 15) and is mounted for rotation therewith by a bearing 113 contained in a housing body 115 of the entry sub-assembly 39. The housing body 115 is a stator, and has gas inlets 117 and drilling liquid inlets 119 in the housing body. A bearing 121 at the bottom of the housing body 115 supports for rotation a distal male connector 123 at the bottom 37 of the entry sub-assembly 39. The adaptor 36 screws on to this male connector 123, and the wear tube pipe extends down through the adaptor 36 to its male connector which connects to the proximal connector 35 of the drill rod 33.

The housing 115 is in two parts, secured together by bolts 125 and nuts 127 spaced circumferentially around a flange formed in the separate parts of the housing 115. O-ring seals 129 seal off the rotating parts 131 of the entry sub-assembly 39 from the housing 115, in order to contain gas forced under compression into the gas inlets 117.

Still referring to FIG. 10, a coaxial tube 133 extends around the wear tube pipe 107, spaced therefrom to form a gas passage 135 which reaches into the adaptor 36, and communicates with the gas passage 61 in an uppermost drill rod 33, to supply gas under pressure (typically compressed air), from the entry sub-assembly 39 down to the gas injector sub assembly 27.

In the housing 115 of the entry sub-assembly 39, extending around circumferentially and connecting with the gas inlets 117 is a circumferential gas passage 139. Four ducts 141 are located in the rotating parts 131 to communicate gas under pressure from the circumferential gas passage 139 to the gas passage 135.

Figure 11:
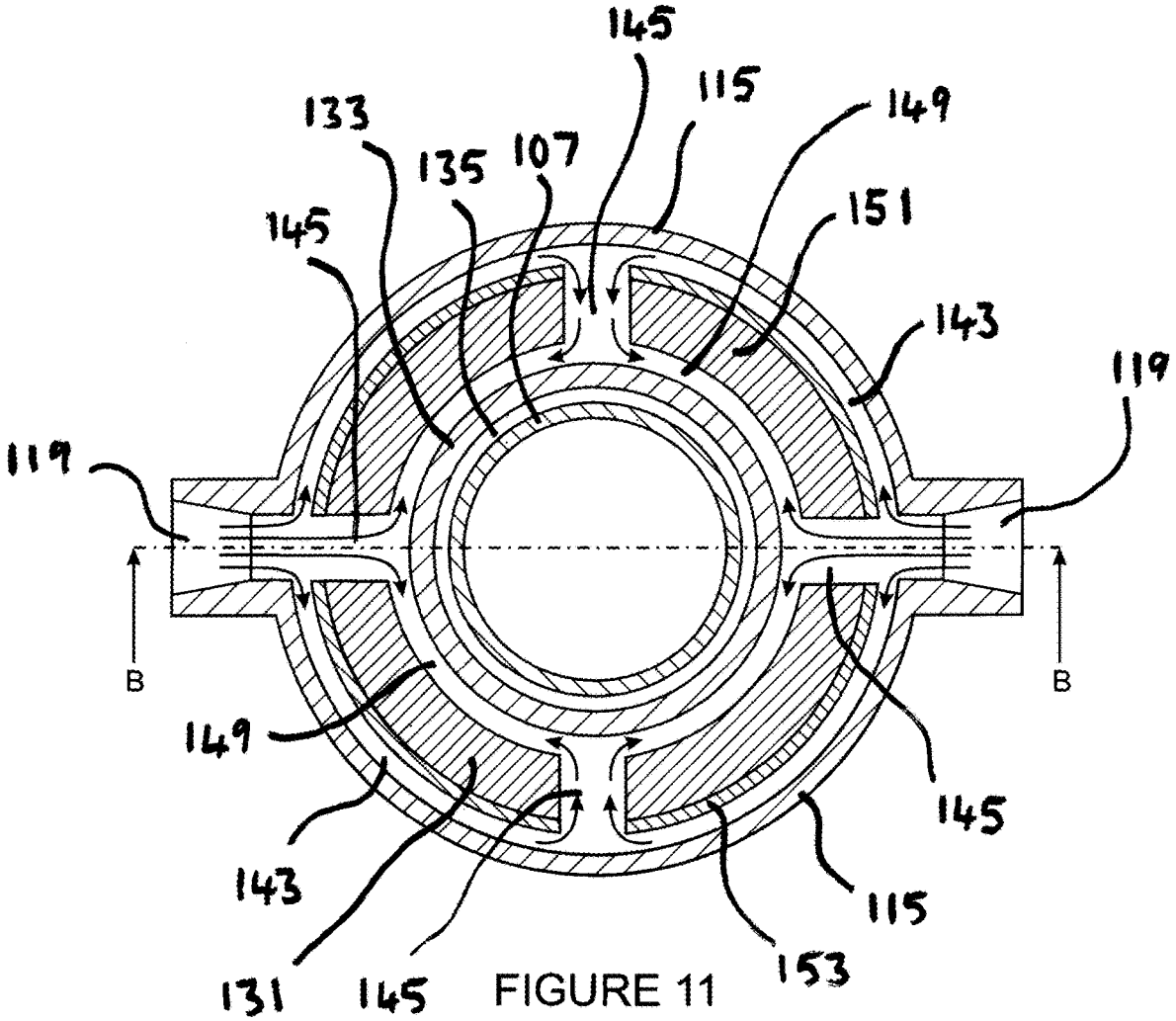
FIG. 11 is a transverse cross-section view through section B-B of FIG. 10.

Referring also to FIG. 11, also in the housing 115 of the entry sub-assembly 39, extending around circumferentially and connecting with the drilling liquid inlets 119 is a circumferential liquid passage 143. Four ducts 145 are located in the rotating parts 131 to communicate drilling liquid under pressure from the circumferential liquid passage 143 to a circumferential liquid passage 149 extending between the outside of the coaxial tube 133 and rotating parts 131 including the male connector 123. The liquid passage 143 communicates drilling liquid under pressure to the liquid passage 59 of the uppermost connected drill rod 33, and thence down past the gas injector subassembly and to the drilling assembly and to the drill bit 11.

Figure 20:
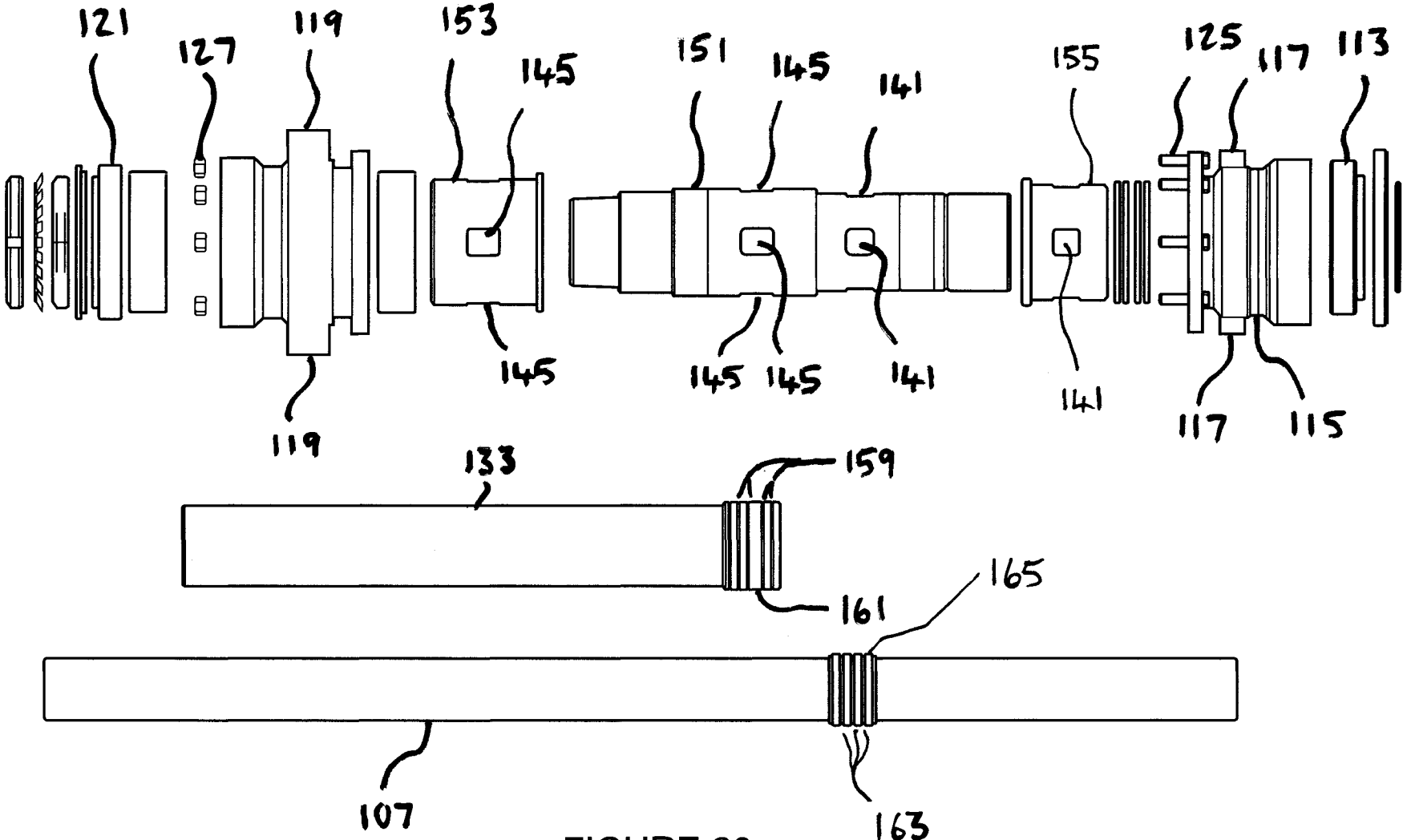
FIG. 20 is an exploded view of components of the entry sub-assembly of FIG. 10.

Referring also to FIG. 20, the rotating parts 131 include a main shaft 151, and a seal wear ring 153 in which the four ducts 145 are located. A seal wear ring 155 located on the main shaft 151 and ducts 141 are located in both of these components. The seal wear rings 153 and 155 are a press fit so as to rotate with the main shaft 151.

O-ring seals 159 are provided on a boss 161 located on the top of the coaxial tube 133 in order to provide a seal between the liquid passage 143 and the gas passage 139.

O-ring seals 163 are provided on a boss 165 located on the outside of the wear tube pipe 107, to seal off the gas passage 135 at the top of the entry sub-assembly 39.

Drilling Arrangements

The embodiment shown in FIG. 16 illustrates the entry sub-assembly 39, the drill rods 33 and the gas injector sub-assembly 27 of the invention (with drill rig rotary head 41 etc.) connected to a reverse circulation rotary drill bit 11 having tri-cone rollers with tungsten or PDC (polycrystalline diamond) cutting edges, or blades with either tungsten or PDC cutting edges. The connected entry sub-assembly 39, drill rods 33 and the gas injector sub-assembly 27 provide three separate flow paths for drill cuttings, compressed air and drilling liquid (drilling mud or water). As drilling proceeds, the well annulus (around the drilling parts) is usually kept flooded to close to or near ground level, and the drill cuttings are evacuated through the central cuttings conduit, and not via the well annulus. Drilling liquid in the form of water is pumped down through the connected liquid passages to the drill bit 11 exiting at the bit face, with compressed air simultaneously pumped down the connected gas passages into and through the apertures 97 in the gas injector sub-assembly 27 located above the drill bit 11. Air introduced into the cuttings conduit 51 through the apertures 97 in the gas injector sub-assembly 27 creates a vacuum effect at the drill bit face, which together with the static downward pressure from mud in the well annulus, causes the drill cuttings to travel from the bit face upwards through the drill bit orifices internally, then into and through the drill string central cuttings conduit of the connected drill rods 33 and entry sub-assembly 39, to the surface.

Figure 17:
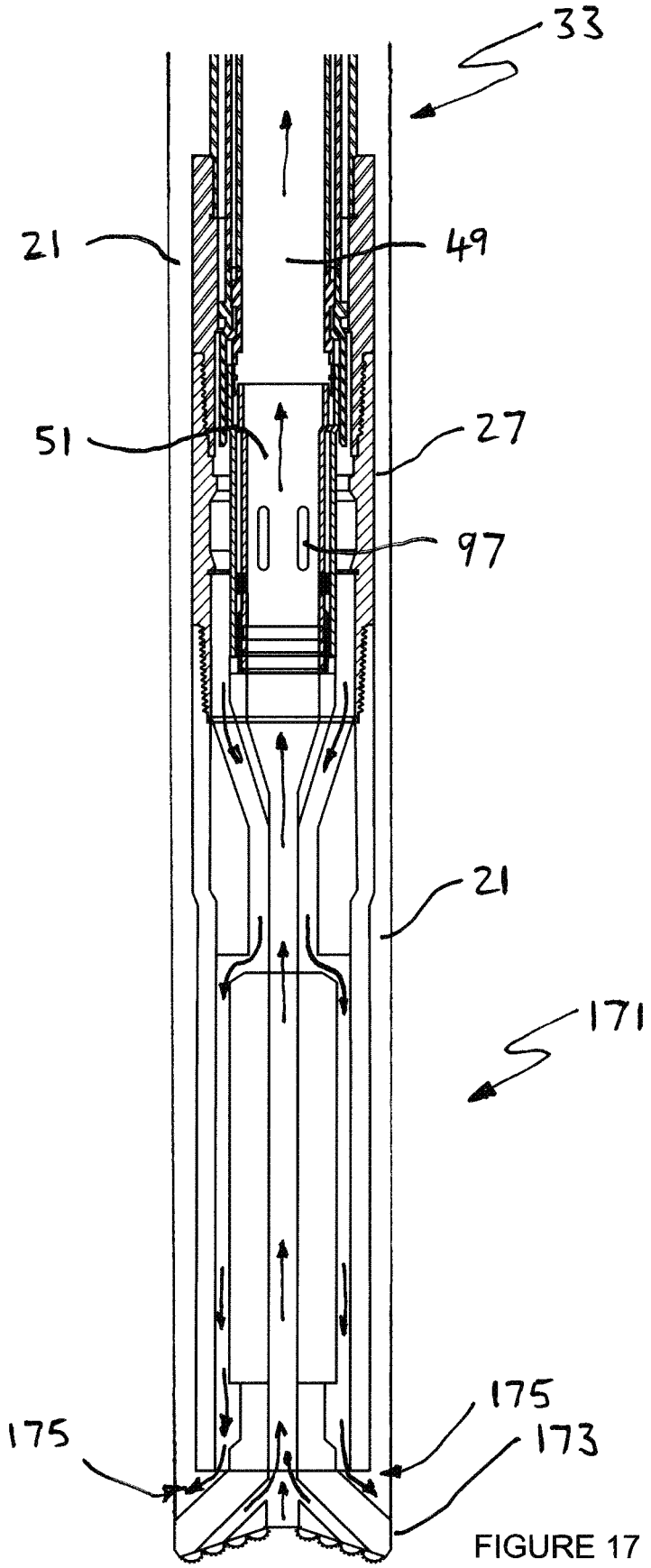
FIG. 17 is a schematic diagram showing a drill rod of FIGS. 2 and 8, with the gas injector sub-assembly of FIG. 1, coupled to a reverse circulation fluid hammer and drill bit in a second embodiment.

The embodiment shown in FIG. 17 illustrates the entry sub-assembly 39, the drill rods 33 and the gas injector sub-assembly 27 of the invention (with drill rig rotary head 41 etc.) connected to a reverse circulation fluid hammer 171 and drill bit 173. The well annulus is flooded with mud, and water pumped through the liquid passages of the connected entry sub-assembly 39, the drill rods 33 and the gas injector sub-assembly 27 powers the hammer mechanism of the fluid hammer 171. Pressurised liquid exiting the hammer mechanism discharges through orifices 175 between the hammer drive chuck and the drill bit splines, moving around the exterior of the drill bit 173 while mixing with drilling mud from the well annulus. Drill cuttings at the drill bit face move upwards through the drill bit 173 internally, passing through the fluid hammer 171 inner tube 177 into the cuttings conduit of the drill string formed by the connected entry sub-assembly 39, drill rods 33 and gas injector sub-assembly 27. Air introduced into the cuttings conduit 51 through the apertures 97 in the gas injector sub-assembly 27 provides lift to the cuttings in the cuttings conduit and creates a vacuum effect at the drill bit face, assisted by the downward static pressure of mud in the well annulus, to enhance cuttings removal up the cuttings conduit to the surface. Cuttings from the bit face are delivered to surface rapidly via the drill string cuttings conduit, due to the positive pressure of fluid discharging at the bit face together with the pressure differential created by the combination of downward static pressure from mud in the well annulus and compressed air being introduced into the gas injector sub-assembly 27.

Figure 18:
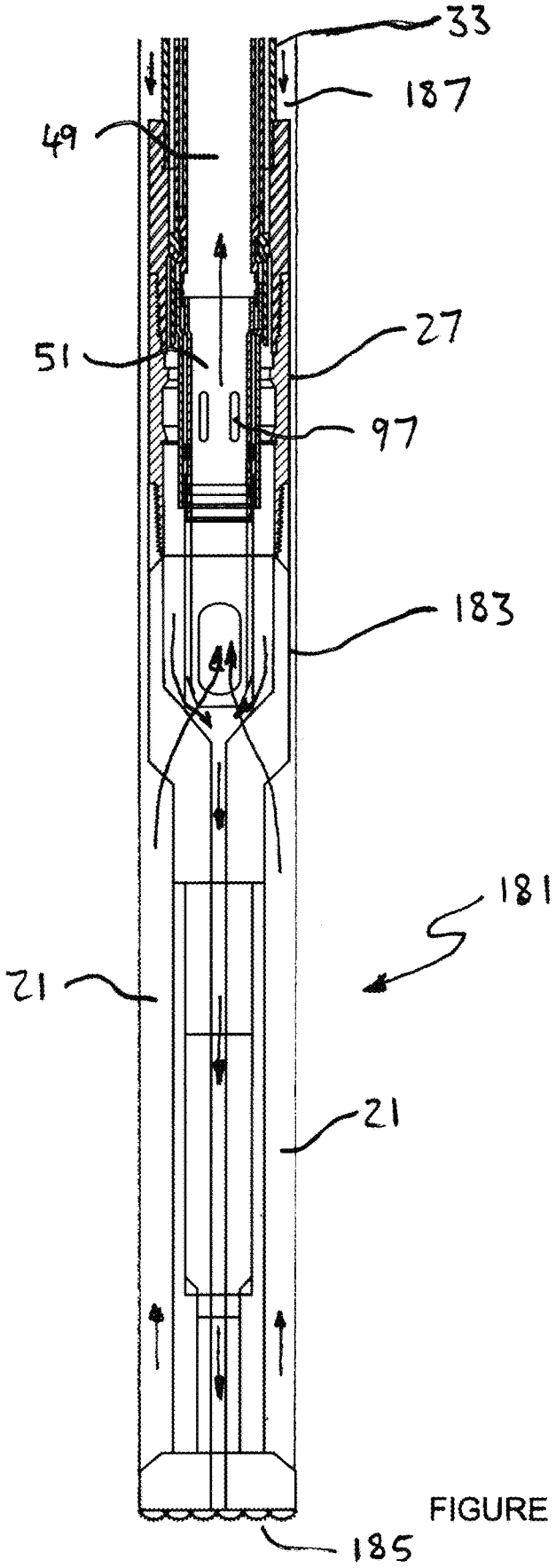
FIG. 18 is a schematic diagram showing a drill rod of FIGS. 2 and 8, with the gas injector sub-assembly of FIG. 1, coupled to a conventional fluid hammer and drill bit in a third embodiment.

The embodiment shown in FIG. 18 illustrates the entry sub-assembly 39, the drill rods 33 and the gas injector sub-assembly 27 of the invention (with drill rig rotary head 41 etc.) connected to a conventional fluid hammer 181 and cross-over sub 183. When used with a flooded mud dual circulation drilling method, this arrangement has advantages over both single flow and dual flow drill strings when coupled to conventional or reverse circulation fluid hammers due to limitations associated with removal of cuttings from the bit face to surface. Where the entry sub-assembly 39, drill rods 33 and the gas injector sub-assembly 27 of the invention are coupled to a conventional water hammer, the liquid passage in the drill string provided by the entry sub-assembly 39, the drill rods 33 and the gas injector sub-assembly 27 of the invention, allows a dedicated fluid path to power the hammer 181 with cuttings removed to surface through the cuttings conduits of the entry sub-assembly 39, drill rods 33 and gas injector sub-assembly 27, via the cross-over sub 183 located above the hammer 181. Drill cuttings are forced upwards from the drill bit face 185 outside the hammer 181 body and into the cross-over sub 183, assisted by fluid pressure exiting the bit from the hammer mechanism 181 and the liquid passage in the drill string provided by the entry sub-assembly 39, the drill rods 33 and the gas injector sub-assembly 27 of the invention, together with the static head pressure from mud in the well annulus 187 and the vacuum effect in the drill string inner tube created by compressed air being introduced into the cuttings conduit via apertures 97 in the gas injector sub-assembly 27.

When compared to conventional single flow fluid hammers, the use of the entry sub-assembly 39, the drill rods 33 and the gas injector sub-assembly 27 of the invention has the advantage of allowing clean drilling fluid to be specifically directed to power a fluid hammer 181 independently of the other fluid paths, thus minimising abrasion and wear normally resulting from the use of more abrasive recycled drilling mud as used in single flow fluid systems when coupled to a fluid hammer.

Figure 19:
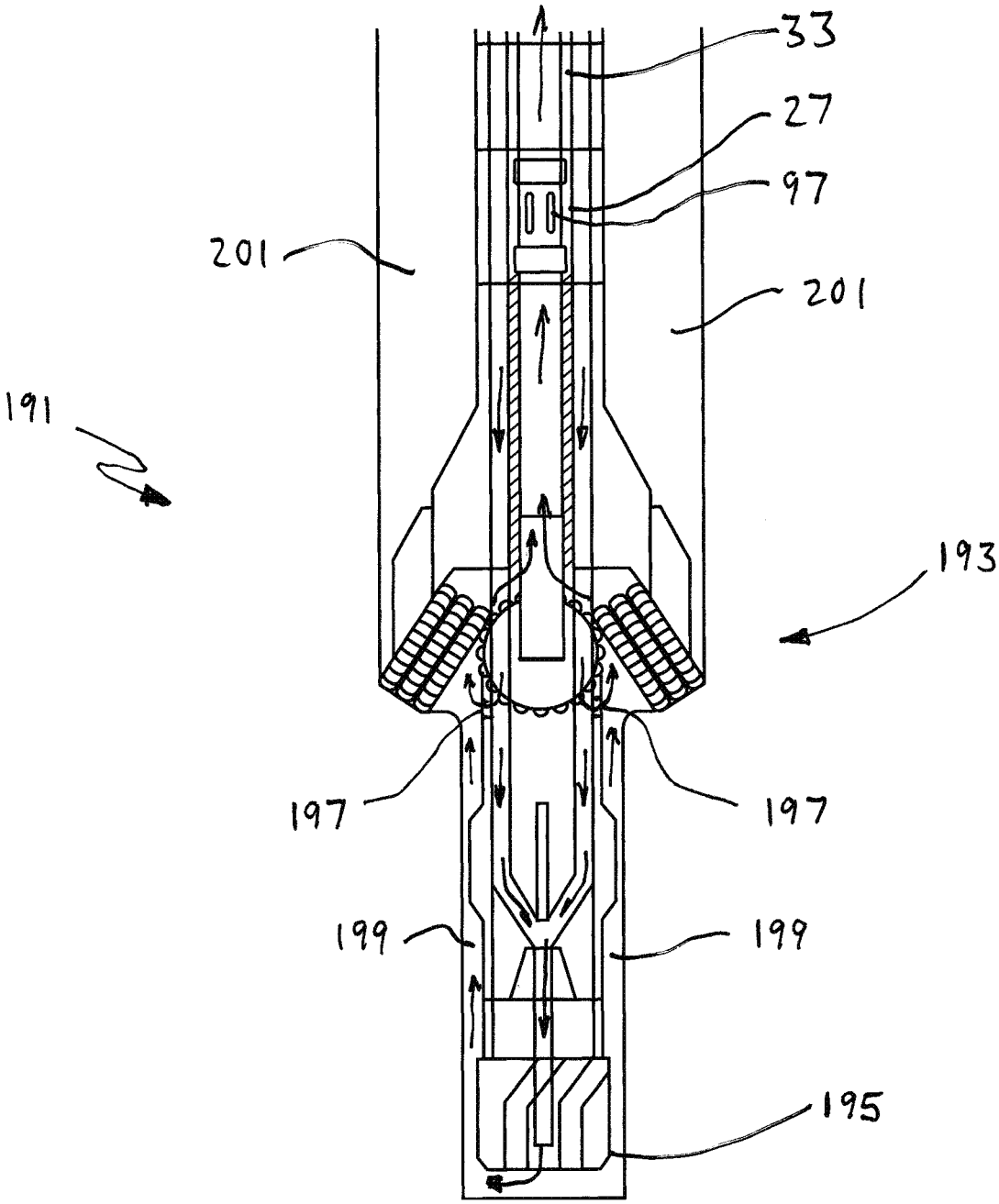
FIG. 19 is a schematic diagram showing a drill rod of FIGS. 2 and 8, with the gas injector sub-assembly of FIG. 1, coupled to a reverse circulation hole opening assembly in a fourth embodiment.

The embodiment shown in FIG. 19 illustrates the entry sub-assembly 39, the drill rods 33 and the gas injector sub-assembly 27 of the invention (with drill rig rotary head 41 etc.) connected to a hole opening assembly 191 consisting of a reamer assembly 193 having either mill tooth rollers, tungsten cutting blades, button type rollers using tungsten or PDC inserts or tungsten or PDC type cutting reamers, and a leading bit 195 having either mill tooth rollers, tungsten cutting blades, button type rollers using tungsten or PDC inserts or tungsten or PDC type cutting blades. High pressure drilling fluid (liquid) from the liquid passage in the drill string provided by the entry sub-assembly 39, the drill rods 33 and the gas injector sub-assembly 27 of the invention, is pumped simultaneously to the face of the leading bit 195 and to jets 197 located in the body of the hole opening assembly 191. Drilling fluid (liquid) simultaneously exiting the jets 197 and exiting at the face of the leading bit 195 provide cuttings removal initially up the leading bit 195 well annulus 199 and then crossing over in the reamer assembly 193 to proceed mixed along with cuttings produced by the reamer assembly 193, up the cuttings conduit of the entry sub-assembly 39, drill rods 33 and gas injector sub-assembly 27. Drill cuttings from both areas combine and travel through the centre of the hole opener assembly 193 into the cuttings conduit of the entry sub-assembly 39, drill rods 33 and gas injector sub-assembly 27, and to surface. Removal of cuttings produced from both the lead bit 195 and the reamer assembly 193 while drilling or reaming is aided by the positive pressure of fluid exiting the bit 195, the combined static downward pressure of drilling fluid in the upper annulus 201, together with the vacuum effect of compressed air pumped into cuttings conduit at apertures 97 in the gas injector sub-assembly 27.

When used with a hole opening assembly 191, the entry sub-assembly 39, the drill rods 33 and the gas injector sub-assembly 27 of the invention provides advantages including but not limited to more rapid and effective cuttings removal via the drill string central cuttings conduit due to the combined simultaneous effect of high pressure fluid exiting at the drill bit faces together with compressed air pumped down from into the entry sub-assembly 39, and through the drill rods 33 to the gas injector sub-assembly 27, where the compressed air is injected entrained cuttings in the cuttings conduit, and static downward pressure from drilling fluid in the upper and lower annulus 201 and 199 forcing cuttings into and through the centre of the hole opening device and through the drill string central inner tube to surface. This compares advantageously with prior art arrangements single or dual flow drill string systems when drilling large diameter holes, which require considerably more fluid volume, time and energy to remove drill hole cuttings via the well annulus.

In all of the above described arrangements the central cuttings conduit evacuates cuttings from the drilling component, up the drill string formed by the drill rods to be delivered to the surface of the drilling operation, counter current to the liquid and gas which are delivered via the liquid passage and the gas passage respectively down the drill string. The drilling component may be a drill bit or a drill bit with a hammer mechanism, and the liquid is delivered to the drill bit, where cuttings are entrained and evacuated toward the entry of the sub-assembly cuttings conduit and/or the cuttings conduit.

The liquid may be a drilling fluid such as a drilling mud or may be water, which is pumped down the liquid passage.

The gas may be air, particularly supplied under pressure/as compressed air, which is supplied down the gas passage. The compressed air is introduced into the cuttings being evacuated from the drilling component, through ports connecting the gas passage to the cuttings conduit in the gas injector sub-assembly (connecting the sub-assembly gas passage to the sub-assembly cuttings conduit), from where it assists in lifting the drilling cuttings up the cuttings conduit, and assists in drawing the cuttings from the cutting surfaces of the drilling component.

Generally, the drilling component is of a greater diameter than the diameter of the drill string (the diameter of each drill rod or the diameter of the cuttings conduits), resulting in an anulus around the drill string (the well annulus), which would normally be flooded with water/mud during the drilling operation. This provides a static downward pressure, which assists in moving drill cuttings toward the cuttings conduit.

The invention provides a triple tube drill string system comprising one or more drill rods which when coupled together form a drill string having three separate fluid paths, each performing a specific function.

The up-hole end of the drill string is attached to a drill rig rotary head having a hollow spindle and the down hole end the drill string is attached to the drilling component, which may be either a reverse circulation rotary drill bit, reverse circulation hole opening bit assembly, a conventional water or fluid hammer or a reverse circulation water or fluid hammer.

The triple tube, triple circulation drill string according to the invention has advantages over existing single circulation or dual circulation drill string systems, including but not limited to more rapid penetration rates in hard rocks and more effective removal of drill cuttings, especially in large diameter wells where rapid and effective removal of cuttings can occur through the cuttings conduit/drill string inner tube when assisted by compressed air pumped into the sub-assembly injector cuttings conduit in the gas injector sub-assembly. The combination of high-pressure water ejected at the drill bit face plus the vacuum effect created by compressed air pumped into the gas injector sub-assembly, assisted by static pressure from mud or drilling fluid in the annulus surrounding the outer drill bodies (between the bored hole and the drill string) acting downwards, results in highly effective cuttings removal through the cuttings conduits of the serially joined drill rods.

This triple tube drill string system provides added flexibility when compared to other prior art systems through being able to alter or direct fluid flow for a number of additional applications such as flushing and clearing downhole blockages by pumping water or drilling fluid directly down the central cuttings conduit or by introducing grout into a well if required. In the event a hammer is in use this allows grouting without the grout having to pass through the hammer internals.

In the event that a well exuding undue pressure at depth requires an injection of high-density mud or drilling fluid to kill the well, or an injection of lost circulation material is required to be pumped into a lost circulation zone, the triple tube drill string system allows the injection of the necessary fluids directly through the central cuttings conduit.

The triple tube drill string system provides rapid delivery of cuttings to the surface through the central cuttings conduit, in both small and large diameter holes when compared to prior art single and dual circulation systems. In prior art systems where cuttings are moved to surface from the bit face outside the drill string via the well annulus, fluid when exiting the bit face under high pressure undergoes a rapid loss of velocity and pressure when exiting the drill string into the well annulus, the well annulus being a much larger cross-sectional area and volume, resulting in the drill cuttings taking longer to reach surface than when the drill cuttings are removed through the central cuttings conduit.

During drill rod connections between downward advances during the drilling process, especially when low viscosity drilling fluid is in use, cuttings produced from each advance are required to be removed from or suspended in the drill hole prior to making connections, otherwise cuttings may settle around the bottom hole assembly and cause the drill string to become stuck. Removal of drill cuttings prior to drill rod connections is faster and more efficient through the triple tube drill string system due to the higher velocity at which cuttings travel to surface through the more confined central cuttings conduit.

The advantages conferred by the triple tube drill string system also apply to current flooded mud dual circulation systems using prior art dual tube drill strings, especially in large diameter and/or deeper wells. The use of the triple tube drill string system provides superior clearance of drill cuttings through the positive flushing at cutting faces from high pressure liquid pumped through the liquid passage of the joined string components, providing more effective clearing of cuttings from the bit or cutting faces when compared to flooded mud dual circulation systems, where no fluid is pumped through the bits or cutting faces. Effective removal of large volumes of, at times, coarse, heavy cuttings is critical and removal thereof more rapid and effective by means of the triple tube drill string system where the liquid passage of the connected components provides positive flushing at the cutting faces of bits and down hole assemblies plus the triple tube drill string system facilitates rapid removal of cuttings through the central cuttings conduit, with lift of the drill cuttings entrained in drilling liquid enhanced by injected air introduced at the gas injector sub-assembly into the central cuttings conduit, which also provides a lower pressure at the drill bit face, assisting in evacuating cuttings therefrom.

It should be appreciated that the scope of the invention is not limited to the specific embodiments described herein, and the skilled addressee will understand that changes may be made to these embodiments without departing from the spirit and scope of the invention.

The invention claimed is:

1. A drill assembly comprising:

a plurality of drill rods connectable in series, a centrally extending cuttings conduit to evacuate drill cuttings therealong, a liquid passage to transport drilling liquid therealong, and a gas passage to transport gas therealong; said drill rods having connectors connecting said cuttings conduit, said liquid passage, and said gas passage between connected said drill rods and maintaining fluid separation of said cuttings conduit, said liquid passage, and said gas passage from each other;

wherein said drill assembly has a gas injector sub-assembly connectable to a distal end of one of said drill rods between said one of said drill rods and a drilling component, said gas injector sub-assembly having a centrally extending sub-assembly cuttings conduit to evacuate drill cuttings therealong received from said drilling component to said cuttings conduit, a sub-assembly liquid passage to transport a drilling liquid therealong received from said liquid passage to said drilling component, and a sub-assembly gas passage to introduce gas to at least one port located within said gas injector sub-assembly extending between said sub-assembly gas passage and said sub-assembly cuttings conduit;

wherein said drill assembly has an entry sub-assembly driven by a drill rig rotary head and connectable to a proximal end of said one of said drill rods spaced away from said gas injector sub-assembly; said entry sub-assembly having a stator with a pressurized liquid inlet and a pressurized gas inlet connecting through a rotary mechanism to said liquid passage and said gas passage respectively; said entry sub-assembly having an entry sub-assembly cuttings conduit to evacuate drill cuttings; and wherein said gas passage and said liquid passage both extend concentrically around said cuttings conduit, and wherein said sub-assembly gas passage extends concentrically around a part of a length of said sub-assembly cuttings conduit, down to said at least one port; and wherein:

each of said drill rods has an outer drill rod body, said gas passage and said liquid passage each include at least one spacer with a plurality of apertures therein, one of said gas passage and said liquid passage is located between an inner wall extending around said cuttings conduit and an inside of a concentric wall extending around said inner wall, and the other of said gas passage and said liquid passage is located between an outside of said concentric wall and said outer drill rod body.

2. The drill assembly as claimed in claim 1, wherein each of said outer drill rod body has a proximal connector at one end and a distal connector at an opposite end, said drill rods being connectable in a string by said proximal connector of one of said drill rods and said distal connector of another of said drill rods to form a connection between each of said drill rods; said connection connecting said cuttings conduit, said liquid passage, and said gas passage between connected said drill rods and maintaining separation of said cuttings conduit, said liquid passage, and said gas passage from each other.

3. The drill assembly as claimed in claim 2, wherein said gas injector sub-assembly has an outer sub-assembly body with a proximal sub-assembly connector at one end and a distal drill assembly connector at an opposite end; said gas injector sub-assembly being connectable by said proximal sub-assembly connector to a said distal connector of said string to form a gas injector sub-assembly connection; said gas injector sub-assembly connection connecting said sub-assembly cuttings conduit with said cuttings conduit, said sub-assembly liquid passage with said liquid passage, and said sub-assembly gas passage with said gas passage, and maintaining separation of said cuttings conduit and said liquid passage from each other; said distal drill assembly connector communicating said sub-assembly cuttings conduit and said sub-assembly liquid passage with respective drill assembly cuttings and liquid connections.

4. The drill assembly as claimed in claim 1, wherein said inner wall is expanded at an end of said cuttings conduit to allow connecting said inner wall of connected drill rods to join by telescoping inner walls.

5. The drill assembly as claimed in claim 4, wherein said concentric wall is expanded at an end of said gas passage, to allow connecting said concentric wall of connected drill rods to join by telescoping concentric walls.

6. The drill assembly as claimed in claim 1, wherein said concentric wall is expanded at an end of said gas passage to allow connecting said concentric wall of connected drill rods to join by telescoping concentric walls.

7. A drill assembly comprising:

a plurality of drill rods, each of said drill rods comprising an outer drill rod body with a proximal connector at one end and a distal connector at an opposite end, a centrally extending cuttings conduit to evacuate drill cuttings therealong, a liquid passage to transport drilling liquid therealong, and a gas passage to transport gas therealong; said drill rods being connectable in a string by said proximal connector of one of said drill rods and said distal connector of another of said drill rods to form a connection between each of said drill rods; said connection connecting said cuttings conduit, said liquid passage, and said gas passage between connected said drill rods and maintaining fluid separation of said cuttings conduit, said liquid passage, and said gas passage from each other;

wherein said drill assembly has a gas injector sub-assembly having an outer sub-assembly body with a proximal sub-assembly connector at one end and a distal drill assembly connector at an opposite end, a centrally extending sub-assembly cuttings conduit to evacuate drill cuttings therealong, a sub-assembly liquid passage to transport a drilling liquid therealong, and a sub-assembly gas passage to introduce gas, and at least one port extending between said sub-assembly gas passage and said sub-assembly cuttings conduit to introduce gas from said sub-assembly gas passage to said sub-assembly cuttings conduit; said gas injector sub-assembly being connectable by said proximal sub-assembly connector to a said distal connector of said string to form a gas injector sub-assembly connection; said gas injector sub-assembly connection connecting said sub-assembly cuttings conduit with said cuttings conduit, said sub-assembly liquid passage with said liquid passage, and said sub-assembly gas passage with said gas passage, and maintaining separation of said cuttings conduit and said liquid passage from each other; said distal drill assembly connector communicating said sub-assembly cuttings conduit and said sub-assembly liquid passage with respective drill assembly cuttings and liquid connections;

wherein said drill assembly has an entry sub-assembly connectable to a said proximal connector by a complimentary connector, and driven by a drill rig rotary head; said entry sub-assembly having a stator with a pressurized liquid inlet and a pressurized gas inlet connecting through a rotary mechanism to said liquid passage and said gas passage respectively via said complimentary connector and said proximal connector; said entry sub-assembly having an entry sub-assembly cuttings conduit to evacuate drill cuttings;

wherein said gas passage extends concentrically around said cuttings conduit, and said liquid passage extends concentrically around said gas passage, along and inside of said outer drill rod body, and wherein said sub-assembly gas passage extends concentrically around said sub-assembly cuttings conduit, and said sub-assembly liquid passage extends concentrically around said sub-assembly gas passage, along and inside of said outer sub-assembly body, the sub-assembly gas passage extending for a part of a length of the sub-assembly liquid passage; and wherein said gas passage includes at least one spacer with a plurality of apertures therein located between an inner wall extending around said cuttings conduit and an inside of a concentric wall extending around said inner wall defining said gas passage; and said liquid passage also includes at least one spacer with a plurality of apertures therein located between an outside of said concentric wall and said outer drill rod body.

8. The drill assembly as claimed in claim 7, wherein said cuttings conduit extends centrally and coaxially with said outer drill rod body.

9. The drill assembly as claimed in claim 7, wherein said sub-assembly cuttings conduit extends centrally and coaxially with said outer sub-assembly body.

10. The drill assembly as claimed in claim 7, wherein said entry sub-assembly cuttings conduit extends centrally and coaxially with said stator.

11. The drill assembly as claimed in claim 7, wherein said liquid passage and said gas passage extend longitudinally between said cuttings conduit and said outer drill rod body.

12. The drill assembly as claimed in claim 7, wherein said sub-assembly liquid passage and said sub-assembly gas passage extend between said sub-assembly cuttings conduit and said outer sub-assembly body.

13. The drill assembly as claimed in claim 7, wherein said inner wall is expanded at an end of said cuttings conduit to allow connecting said inner wall of connected drill rods to join by telescoping inner walls.

14. The drill assembly as claimed in claim 7, wherein said concentric wall is expanded at an end of said gas passage to allow connecting said concentric wall of connected drill rods to join by telescoping concentric walls.

15. A method of drilling a bore hole, the method comprising:

providing a drill assembly having a plurality of drill rods connectable in series, each of said drill rods having a centrally extending cuttings conduit connectable in series to evacuate drill cuttings therealong, a liquid passage connectable in series to transport drilling liquid therealong, and a gas passage connectable in series to transport gas therealong; wherein said gas passage extends concentrically around said cuttings conduit, and said liquid passage extends concentrically around said gas passage, along and inside of an outer drill rod body; wherein said gas passage includes at least one spacer with a plurality of apertures therein located between an inner wall extending around said cuttings conduit and an inside of a concentric wall extending around said inner wall defining said gas passage; and said liquid passage also includes at least one spacer with a plurality of apertures therein located between an outside of said concentric wall and said outer drill rod body; said drill rods having connectors connecting said cuttings conduit, said liquid passage, and said gas passage between connected said drill rods and maintaining fluid separation of said cuttings conduit, said liquid passage, and said gas passage from each other;

providing in said drill assembly a gas injector sub-assembly connectable to a distal end of one of said drill rods between said one of said drill rods and a drilling component, said gas injector sub-assembly having a centrally extending sub-assembly cuttings conduit to evacuate drill cuttings therealong received from said drilling component to said cuttings conduit, a sub-assembly liquid passage to transport a drilling liquid therealong received from said liquid passage to said drilling component, and a sub-assembly gas passage to introduce gas to at least one port located within said gas injector sub-assembly extending between said sub-assembly gas passage and said sub-assembly cuttings conduit; wherein said sub-assembly gas passage extends concentrically around said sub-assembly cuttings conduit, and said sub-assembly liquid passage extends concentrically around said sub-assembly gas passage, along and inside of an outer sub-assembly body, the sub-assembly gas passage extending for a part of a length of the sub-assembly liquid passage;

providing in said drill assembly an entry sub-assembly driven by a drill rig rotary head and connectable to a proximal end of said one of said drill rods spaced away from said gas injector sub-assembly; said entry sub-assembly having a stator with a pressurized liquid inlet and a pressurized gas inlet connecting through a rotary mechanism to said liquid passage and said gas passage respectively; said entry sub-assembly having an entry sub-assembly cuttings conduit to evacuate drill cuttings; and delivering liquid under pressure to said pressurized liquid inlet and down said liquid passage to said drilling component, evacuating drill cuttings up said cuttings conduit from said drilling component, and delivering gas under pressure into said pressurized gas inlet and down said gas passage where the gas under pressure enters said cuttings conduit in said gas injector sub-assembly to provide lift to cuttings and liquid slurry contained in said cuttings conduit.

16. The method as claimed in claim 15, wherein, a well annulus extending between drill assembly and said bore hole drilled by said drilling component, is maintained in a flooded condition as drilling proceeds.

17. A drill assembly comprising:

a plurality of drill rods connectable in series, a centrally extending cuttings conduit to evacuate drill cuttings therealong, a liquid passage to transport drilling liquid therealong, and a gas passage to transport gas therealong; said drill rods having connectors connecting said cuttings conduit, said liquid passage, and said gas passage between connected said drill rods and maintaining fluid separation of said cuttings conduit, said liquid passage, and said gas passage from each other;

wherein said drill assembly has a gas injector sub-assembly connectable to a distal end of one of said drill rods between said one of said drill rods and a drilling component, said gas injector sub-assembly having a centrally extending sub-assembly cuttings conduit to evacuate drill cuttings therealong received from said drilling component to said cuttings conduit, a sub-assembly liquid passage to transport a drilling liquid therealong received from said liquid passage to said drilling component, and a sub-assembly gas passage to introduce gas to at least one port located within said gas injector sub-assembly extending between said sub-assembly gas passage and said sub-assembly cuttings conduit;

wherein said drill assembly has an entry sub-assembly driven by a drill rig rotary head and connectable to a proximal end of said one of said drill rods spaced away from said gas injector sub-assembly; said entry sub-assembly having a stator with a pressurized liquid inlet and a pressurized gas inlet connecting through a rotary mechanism to said liquid passage and said gas passage respectively; said entry sub-assembly having an entry sub-assembly cuttings conduit to evacuate drill cuttings;

wherein said gas passage and said liquid passage both extend concentrically around said cuttings conduit, and wherein said sub-assembly gas passage extends concentrically around a part of a length of said sub-assembly cuttings conduit, down to said at least one port;

wherein each of said drill rods comprises an outer drill rod body with a proximal connector at one end and a distal connector at an opposite end, said drill rods being connectable in a string by said proximal connector of one of said drill rods and said distal connector of another of said drill rods to form a connection between each of said drill rods; said connection connecting said cuttings conduit, said liquid passage, and said gas passage between connected said drill rods and maintaining separation of said cuttings conduit, said liquid passage, and said gas passage from each other; and wherein said gas passage includes at least one spacer with a plurality of apertures therein, said gas passage located between an inner wall extending around said cuttings conduit and an inside of a concentric wall extending around said inner wall defining said gas passage; and said liquid passage also includes at least one spacer with a plurality of apertures therein, said liquid passage located between an outside of said concentric wall and said outer drill rod body.

18. The drill assembly of claim 17, wherein said inner wall is expanded at an end of said cuttings conduit, to allow connecting said inner wall of connected drill rods to join by telescoping inner walls.

19. The drill assembly of claim 18, wherein said concentric wall is expanded at an end of said gas passage, to allow connecting said concentric wall of connected drill rods to join by telescoping concentric walls.

20. The drill assembly of claim 17, wherein said concentric wall is expanded at an end of said gas passage, to allow connecting said concentric wall of connected drill rods to join by telescoping concentric walls.

* * * * *